US007354701B2

(12) United States Patent
Clark et al.

(10) Patent No.: US 7,354,701 B2
(45) Date of Patent: Apr. 8, 2008

(54) PHOTOGRAPHIC ELEMENT WITH SPEED-ENHANCING COMPOUND

(75) Inventors: Bernard A. Clark, Berkshire (GB); Philip A. Allway, Hertfordshire (GB); Tania Zuberi, Middlesex (GB); Stephen P. Singer, Spencerport, NY (US); Charles E. Heckler, Rochester, NY (US); Louis E. Friedrich, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/574,394

(22) PCT Filed: Oct. 1, 2004

(86) PCT No.: PCT/GB2004/004207

§ 371 (c)(1),
(2), (4) Date: Mar. 31, 2006

(87) PCT Pub. No.: WO2005/036263

PCT Pub. Date: Apr. 21, 2005

(65) Prior Publication Data

US 2007/0128560 A1 Jun. 7, 2007

(30) Foreign Application Priority Data

Oct. 4, 2003 (GB) ..... 0323282.4

(51) Int. Cl.

| | |
|---|---|
| ***G03C 1/46*** | (2006.01) |
| ***G03C 1/06*** | (2006.01) |
| ***G03C 1/005*** | (2006.01) |
| ***G03C 1/494*** | (2006.01) |

(52) U.S. Cl. ..... 430/502; 430/503; 430/504; 430/505; 430/506; 430/567; 430/600; 430/611; 430/613

(58) Field of Classification Search ..... 430/502–506, 430/600, 611, 613, 567
See application file for complete search history.

(56) References Cited

U.S. PATENT DOCUMENTS

| | | | | |
|---|---|---|---|---|
| 6,319,660 | B1 | 11/2001 | Allway et al. | |
| 7,074,550 | B2 * | 7/2006 | Miki | 430/506 |
| 7,115,356 | B2 * | 10/2006 | Toyoda et al. | 430/502 |

FOREIGN PATENT DOCUMENTS

| | | |
|---|---|---|
| EP | 1 072 952 | 1/2001 |
| EP | 1 016 912 | 8/2003 |

* cited by examiner

*Primary Examiner*—Geraldina Visconti
(74) *Attorney, Agent, or Firm*—Arthur E. Kluegel

(57) ABSTRACT

The invention provides a color photographic element comprising at least one light-sensitive silver halide emulsion layer or a non silver-containing light-insensitive layer, in which at least one of these layers contains a colorless heterocyclic compound having either one or two hetero atoms in the ring or ring system, being other than an imidazole compound, that undergoes less than 10% chemical or redox reaction directly with oxidized developer and which has a partition coefficient to enable the photographic speed of the element to be increased by at least 0.03 stop without increasing granularity, compared to the same element without the compound. The heterocyclic compounds increase speed without a concomitant increase in size of the light-sensitive silver halide grains.

27 Claims, No Drawings

PHOTOGRAPHIC ELEMENT WITH SPEED-ENHANCING COMPOUND

CROSS REFERENCE TO RELATED APPLICATION

This application is cross-related to co-filed UK patent application No. 0323280.8.

FIELD OF THE INVENTION

This invention relates to a colour photographic element containing a speed-enhancing heterocyclic compound having either one or two heteroatoms in the ring system in a layer containing a light-sensitive silver halide emulsion layer and/or in a non-silver containing light-insensitive layer.

BACKGROUND OF THE INVENTION

It is a long-standing objective of origination colour photographic materials to maximize the overall response to light while maintaining the lowest possible granularity. Increased photographic sensitivity to light, commonly referred to as photographic speed, allows for improved images captured under low light conditions or improved details in the shadowed regions of the image. In general, the overall sensitivity to light provided by the light-sensitive silver halide emulsions in such systems is determined by the size of the emulsion grains. Larger emulsion grains capture more light. Upon development, the captured light is ultimately converted into dye deposits that constitute the reproduced image. However, the granularity exhibited by these dye deposits is directly proportional to the size of the silver halide grains. Thus, larger silver halide grains have higher sensitivity to light but also lead to higher granularity in the reproduced image. Therefore, it is a fundamental problem in photography to improve the light sensitivity of a silver halide element without a corresponding increase in granularity, hereinafter referred to as a 'speed/grain effect'. Stated from another perspective, it has been a long-standing problem to provide materials which maximise the response to light of a silver halide emulsion for any given grain size.

Many different classes of heterocyclic materials are known to affect silver development in some manner and have been called, for example, antifoggants, fog restrainers, development restrainers, development inhibitors and stabilizers. Descriptions of these materials can be found in *The Fundamentals of Photographic Technology, Silver Salt Photography*, compiled by the Photographic Society of Japan (Corona, Ltd.), p 354; *Chemistry of Photography*, A. Sasai (Shashin Kogyo Shuppan Co, Ltd.), pp 168-169 and T. H. James, Ed, *The Theory of the Photographic Process*, $4^{th}$ Edition, Macmillan Publishing Co, NY, Chapter 13, Section J. Commonly, these materials all contain an —NH or —SH group which allows them to bond or strongly adsorb to the silver surface and whose silver salts have a $pK_{sp}$ ($-\log K_{sp}$) of more than 10, wherein $K_{sp}$ is the solubility product in water at 25 C.

It is well known to add these materials to silver halide emulsions in conventional colour photographic systems to limit or decrease their development. These materials are generally at least partially water-soluble or soluble in water-miscible solvents such as methanol and are added directly to silver emulsions before coating of the film or added directly to the developer solutions. It is also known to attach these types of heterocycles covalently to PUGs (photographically useful groups) so that the PUG will be held in close proximity to the silver surface see, for example, in U.S. Pat. No. 5,100,761.

U.S. Pat. Nos. 5,032,499, 4,837,141 and JP 62-138850 describe the use of a wide variety of photographic restrainers, including diazoles, in thermally developable light-sensitive materials. JP 10-50047 describes a wide variety of anti-silver sludging agents, including diazoles, in a non-light-sensitive cleaning film and JP 63-24255 describes a wide variety of diazoles in a colour photographic film.

U.S. Patent Application Publication No. 2002/0045138 discloses certain imidazoles that can be used in photographic materials to improve granularity without an increase in fogging. The imidazoles are required to be N-substituted unless two adjacent substituents join to form a phenanthrene ring.

U.S. Pat. No. 5,187,054 discloses a photographic material which comprises a ballasted heterocycle, such as a benzimidazole, located in a non light-sensitive layer to reduce sludge formed during the development process, but these compounds do not give a 'speed/grain effect'.

U.S. Pat. No. 5,702,877 describes the use of ballasted benzimidazoles to improve granularity with certain pyrazolone image couplers.

U.S. Pat. No. 6,319,660 describes speed-improving compounds with, specifically, at least three heteroatoms in the ring system in a layer that contains a light-sensitive silver halide emulsion or in a non silver-containing light-insensitive layer. Among the speed-improving compounds described are purines, benzotriazoles, triazoles and thiadiazoles. Indeed, generally it had been considered that for a 'speed/grain effect' to be observed, it was necessary for a heterocyclic compound to have at least three heteroatoms in the ring system, thereby limiting the range of suitable compounds.

PROBLEM TO BE SOLVED BY THE INVENTION

It is highly desirable to be able to extend the range of compounds that can provide an imaging material with increased photographic speed without increase in the size of the light-sensitive silver halide grains, or that can provide the same photographic speed with smaller light-sensitive silver halide grains, especially if those compounds can be synthesized more economically and/or are more readily available.

SUMMARY OF THE INVENTION

It has now been found that certain heterocyclic compounds having either one or two heteroatoms in the ring system can also show the 'speed/grain effect' if the partition coefficient is appropriate to the class and especially if the partition coefficient and the electronic effects of the substituents are suitably balanced.

According to the present invention there is provided a colour photographic element comprising at least one light-sensitive silver halide emulsion layer or a non silver-containing light-insensitive layer, in which at least one of these layers contains a colourless heterocyclic compound having either one or two heteroatoms in the ring or ring system, being other than an imidazole compound, that undergoes less than 10% chemical or redox reaction directly with oxidized developer and which has a partition coefficient to enable the photographic speed of the element to be increased by at least 0.03 stop without increasing granularity, compared to the same element without the compound.

In another embodiment of the invention there is provided a multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element is as herein described.

In yet another embodiment of the invention there is provided a process of forming an image in a photographic element as hereinbefore defined after the element has been imagewise exposed to light, comprising contacting the element, as herein described, with a colour developing agent.

ADVANTAGEOUS EFFECT OF THE INVENTION

The heterocyclic compounds for use in the invention increase speed without a concomitant increase in size of the light-sensitive silver halide grains and hence the granularity, increasing the range of compounds that exhibit this 'speed/grain effect'. They are generally easier to synthesise and/or more readily available than their counterparts having at least three heteroatoms in the ring system.

DETAILED DESCRIPTION OF THE INVENTION

The invention is generally as described in the Summary of the Invention. The term "heteroatom" as used herein encompasses any atom other than carbon or hydrogen and includes, for example, nitrogen, sulfur, phosphorous and oxygen. The term "heteroatom" refers only to those atoms which form an integral part of the ring system and not those that are located externally to the ring system or separated from it by at least one single, unconjugated bond or are part of an additional substituent of the ring system. In particular the term "either one or two heteroatoms", expressly excludes the presence of three or more heteroatoms in the integral ring system. The term 'imidazole compound' excluded herein includes an unsubstituted or substituted imidazole compound forming part of a fused unsubstituted or substituted ring system containing no further ring heteroatoms, such as, for example a benzimidazole ring.

The compounds are colourless so that excluded from the scope are coloured materials or dyes such as, for example, sensitizing dyes, filter dyes and antihalation dyes.

The phrase that the compound useful in the invention "undergoes less than 10% chemical or redox reaction directly with oxidized developer" is meant to be an in-film result following the development step(s) of the photographic process. This restriction is made to distinguish compounds useful in the invention from other photographic materials that are commonly known to react to a greater extent with oxidized developer such as, but not limited to, couplers, scavengers of oxidized developer and electron transfer agents. This can be tested by the standard analysis of a standard film before and after standard processing for the presence of the compound, wherein any loss of compound useful in the invention caused by the processing should be less than 10% conversion in the compound.

Thus the compounds useful in the invention are not couplers and do not react with oxidized developer ($D_{ox}$) to generate dyes or any other product by undergoing any significant amount (less than 10%, preferably less than 5%) of chemical or redox reaction directly with oxidized colour developer. They should be stable to other components of the processing solutions and not contain substituents that undergo substantial amounts of chemical reaction in any of the processing solutions. For example, the materials for use in the invention may not contain hydrazino or hydroquinone groups-that may cross-oxidize during silver development, nor may they be covalently linked to any other kind of PUG. However, they may contain, for example, ester substituents that are not substantially hydrolyzed (less than 5-10%) during the development process.

One of the most important and novel characteristics of the compounds for use in this invention is the finely tuned balance between their lipophilic and lipophobic nature. The lipophilicity of a compound is known to be a key factor in governing if the compound has the required speed/granularity or not and generally those with low lipophilicity were found not to be suitable, whereas compounds with higher lipophilicity were suitable.

The partition coefficient of a compound provides a means of gauging its lipophilicity but this is not a convenient property to measure. The lipophilic/lipophobic nature of a compound can, however, be estimated by calculation of its partition coefficient between octanol and water. In order to maximize the photographic effect, the partitioning into water cannot be too high. Because it can be difficult to measure log P values above 3, a model can be used to compute an estimate of log P that defines the limits of the invention.

In some instances (i.e. U.S. Pat. No. 6,319,660) C log P was used as a predictor of log P and the model used therein utilizes the software program by W. Meylan from Syracuse Research Corporation, 6225 Running Ridge Road, North Syracuse, N.Y., 13212. The compound whose log P is desired is entered into the program called KowWin, 32-bit Version 1.66, written in year 2000. The computed log P is then called Log Kow. A literature article that describes the program is W. M. Meylan and P. H. Howard, 'Atom/fragment contribution method for estimating octanol-water partition coefficients', J. Pharm. Sci. 84: 83-92, 1995.

Thus Log Kow using the KowWin program can be used to define the values of Log Kow for any class of compound which exhibits the desired effect. The terms 'ballast' or 'ballasted' as generally applied in the photographic art are often applied only loosely and without quantification to imply a restriction of movement. The activity of the compounds for use in the invention is therefore best defined in terms of their calculated Log Kow values.

One reason for having the Log Kow or lipophilicity high enough is so that there will be a speed gain when the compound is present in the same melt as the emulsion prior to coating. Preferably the lipophilicity is sufficiently high that there will be the required speed increase even when the melt is held for at least one hour prior to coating.

Different heterocyclic classes function as enhancers of speed within different Log Kow ranges and the minimum Log Kow value needed to enable compounds to deliver a speed gain differs from class to class. Below this minimum value of Log Kow the compounds do not produce the required speed gain. Typically, heterocycles for use in the invention have a Log Kow of at least 6, more preferably at least 7 but normally less than 15, most preferably at least 8 but less than 13, although certain types of heterocycles may require Log Kow above or below these particular values.

The compounds for use in the invention achieve an improvement in terms of photographic speed of at least 0.03, desirably at least 0.05, more desirably at least 0.10 and even 0.25 stops or more, without causing a significant increase in granularity.

By one-stop increase in speed is meant that 50% of the standard amount of scene light gives the same photographic effect as a coating that does not have such a speed increase. The formula that relates 'stop' to light exposure is $$\log(E/E_s)=(\text{stop})\log(0.50),$$

wherein stop is the measure of speed increase, $E_s$ is the standard exposure, and $E/E_s$ is the fractional exposure required as a result of the increase in speed. For example, a zero-stop increase means $E/E_s$ is unity. A 1 stop increase in speed means $E/E_s$ is 0.50. A 0.10 stop increase in speed corresponds to an $E/E_s$ equal to 0.93. A 0.03 stop increase in speed corresponds to an $E/E_s$ equal to 0.98.

Thus the compounds useful in the invention have a Log Kow high enough to improve speed by at least 0.03 stop, compared to the coating without the compound.

The compounds useful in the invention are located in the film element as described and are not added to the processing solutions.

The compounds useful in the present invention are similar to compounds known to cause inhibition of silver development, but because of their increased lipophilicity (indicated by a higher partition coefficient) they do not cause inhibition of silver development per se. Formulations useful for the purpose of the invention, namely an increase in photographic speed without granularity penalty, have the desired overall lipophilicity and do not cause a significant inhibition of silver development.

Among the classes of compounds that contain one or two heteroatoms in the ring system, some of which are known to cause inhibition of silver development, those that can be included in the invention when appropriately substituted to increase lipophilicity are: thiazoles, thiophenes, pyrroles, furans, oxazoles, pyrazoles, pyridines, pyridazines, pyrimidines, pyrazines, oxazines, thiazines, diazepines, oxazepines and thiazepines. Additionally included are any fused polycyclic derivatives of these, provided that the total number of heteroatoms in the fused polycyclic system does not exceed two, such as, for example, pyrrolopyrimidines, quinolines, benzoxazoles, naphthyridines, benzoxazepines, indoles and benzothiazoles.

Preferably the compounds for use in the invention may be selected from thiazoles, pyrimidines and pyridazines. For the thiazoles the Log Kow values will be at least 8, preferably at least 10, especially at least 11. The Log Kow values for the pyrimidines and pyridazines will be at least 6, preferably at least 6.5, especially at least 7.

For the purposes of this invention, the Log Kow refers to neutral molecules, even if they would be ionized or protonated (either fully or in part) at the processing pH or at the ambient pH of the photographic film. Thus, in practice it is highly desirable that the substituents of the compound useful in the invention do not normally contain additional very low $pK_a$ (<7) groups, such as sulfonic or carboxylic acids, nor very basic groups (pKa of conjugate acid <10), such as a tertiary amino group (unless such an amino group is attached to a heterocyclic ring such that it is conjugated to a nitrogen atom, in which case its basicity is greatly reduced or is attached to an electronegative group such as carbonyl or sulfonyl), since they require an increase in the size and amount in the rest of the lipophilic substituents in order to meet the overall Log Kow requirements.

As used herein and throughout the specification unless where specifically stated otherwise, the term "alkyl" refers to an unsaturated or saturated, straight or branched chain alkyl group, including alkenyl and aralkyl, and includes cyclic alkyl groups, including cycloalkenyl, having 3-8 carbon atoms and the term "aryl" includes specifically fused aryl.

Any substituents located directly on the heterocycles useful in the invention may be chosen such that together the entire compound meets an overall partition coefficient requirement. These may, for example, be halo such as fluoro, chloro, bromo or iodo, cyano, hydroxy, nitro or unsubstituted or substituted alkyl, aryl, alkoxy or aryloxy, alkyl- or aryl-thio, mercapto, alkyl- or aryl-sulfinyl, alkyl- or aryl-sulfonyl, alkyl- or aryl-acylamino, alkyl- or aryl-ureido, alkyl- or aryl-carbamato, alkyl- or aryl-sulfonylamino, alkyl- or aryl-sulfamoyl, alkyl- or aryl-oxycarbonyl, alkyl- or aryl-oxysulfonyl, a heterocyclic group, such as furanyl or morpholino, a carbonyl group, such as keto, formyl, carboxylic acid, alkyl- or aryl-carbonyl, alkyl- or aryl-carbamoyl, alkyl- or aryl-carbonamido or an alkyl- or aryl-amino group, such as a primary, secondary or tertiary substituted nitrogen. These groups may be further substituted, for example with one or more of the above groups, which may in turn be further substituted. In addition, the substituent may further contain a group that can be incorporated into a polymeric backbone so long as the monomeric species meets the Log Kow limitations. It should be noted wherever it is possible to write alternative tautomeric structures of the heterocyclic nucleus, these are considered to be chemically equivalent and are part of the invention.

Typically a satisfactory speed increase is found when the compound is substituted with groups that together contain at least eight, preferably at least twelve, more preferably at least fourteen carbon atoms, and especially when the compound has an ionizable —NH group as a substituent either in the ring or ring system or more generally as an exocyclic substituent.

In a particular embodiment the structure of the speed-enhancing compound corresponds to formula (I):

(I)

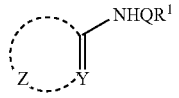

wherein

NHQ is selected from the class consisting of amido, ureido arylamino, carbamato or sulfonamido;

$R^1$ is a substituent;

Y is carbon or nitrogen; and

Z represents the atoms necessary to complete an unsubstituted or substituted five-, six- or seven-membered ring which may form part of a fused unsubstituted or substituted ring system, the ring or ring system containing either one or two heteroatoms selected from nitrogen, oxygen and sulfur, which may be bridgehead atoms;

provided that if Y is carbon, Z contains one or two heteroatoms but if Y is nitrogen Z must not contain more than one heteroatom.

It has been found that in most cases, in order to show the optimum 'speed/grain effect', the compound of formula (I) will have one or more electron-withdrawing groups attached either to the heterocyclic nucleus or to a substituent. Typically, for example, Q is or contains an electron-withdrawing group, such as a carbonyl group or a sulfonyl group, such that the group NHQ is an amido, ureido, carbamato or sulfonamido group. When NHQ is an amido, ureido or carbamato group generally it will be found to be advantageous for there to be present one or more further electron-withdrawing groups on the heterocyclic ring or ring system. When NHQ is a sulfonamido group, then the ring or ring system may be unsubstituted or substituted with one or more electron-withdrawing or electron-donating groups. For those compounds wherein Q is not an electron-withdrawing group, for example an aryl group, then generally it has been found that one or more electron-withdrawing groups will normally be required on the heterocyclic ring or ring system.

Preferably in the compound of formula (I), Y is a nitrogen atom and more preferably Z represents the atoms necessary to form an unsubstituted or substituted thiazole, pyrimidine or pyridazine ring.

In accordance therewith, particularly preferred structures have one of the formulae:

(IIA)

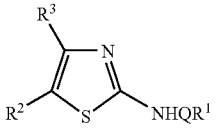

(IIB)

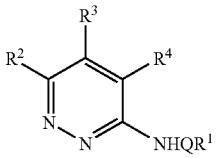

(IIC)

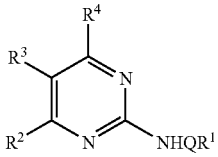

(IID)

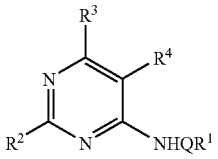

wherein $R^1$, $R^2$, $R^3$ and $R^4$ are independently selected substituents; and NHQ is selected from the class consisting of an amido, ureido arylamino, carbamato or sulfonamido group.

Preferably $R^1$ is selected from hydrogen and an unsubstituted or substituted alkyl, aryl, alkoxy, aryloxy, or alkyl- or aryl-amino group. When Q is or contains a carbonyl group then $R^1$ is preferably an alkyl group which is unsubstituted or substituted, for example, with an aryloxy group, which may itself be substituted, for example with one or more alkyl groups. When Q is or contains a sulfonyl group, $R^1$ is preferably an aryl group, in particular substituted with an alkyl carbonamido group, which may itself be substituted. When Q is an aryl group then $R^1$ may, for example, be an alkoxy group Preferably Q is a carbonyl or sulfonyl group. More preferably, at least one of $R^2$ to $R^4$ is an electron-withdrawing group, especially when the compound of formula (I) is a thiazole of formula (IIA)

By electron-withdrawing group is meant a group with a positive Hammett op value, as described by Hansch et al in Chem. Rev. 1991 91 165-195, "A Survey of Hydrogen Substituent Constants and Resonance Field Parameters". Suitable groups may include, for example, a cyano, carbonyl, alkoxycarbonyl, trifluoromethyl, sulfonyl, sulfoxyl or thio group.

Suitably $R^2$ to $R^4$ are independently selected from hydrogen, cyan, formyl, keto, carboxylic acid, mercapto and unsubstituted or substituted alkyl (including specifically trifluoromethyl), aryl, alkoxy, aryloxy, alkoxy- or aryloxy-carbonyl, alkyl- or aryl-carbonyl, alkyl- or aryl-thio, alkyl- or aryl-sulfoxyl, alkyl- or aryl-sulfonyl, alkyl- or aryl-carbamoyl and alkyl- or aryl-carbonamido, which may be further substituted, or two of $R^2$ to $R^4$ may join to form a fused ring which does not contain any heteroatoms but may be substituted.

The following are examples of compounds that are useful in this invention, with log Kow values in parentheses:

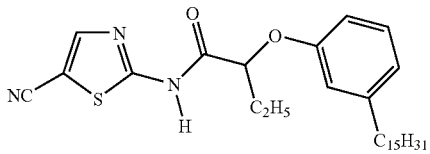

SGA1 (11.01)

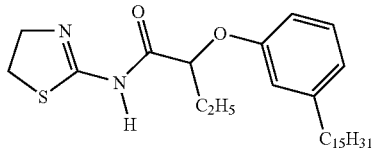

SGA2 (10.67)

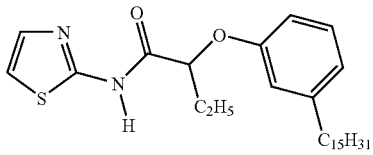

SGA3 (10.91)

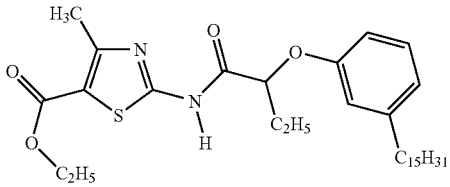

SGA4 (11.78)

-continued
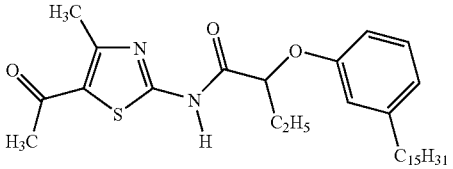
SGA5 (11.14)
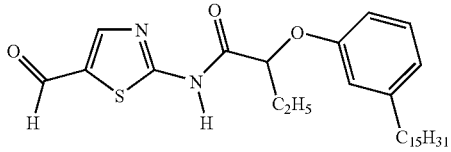
SGA6 (10.63)
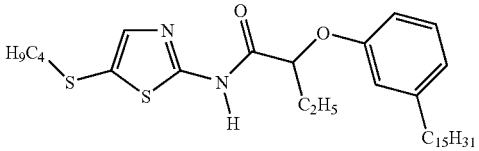
SGA7 (12.98)
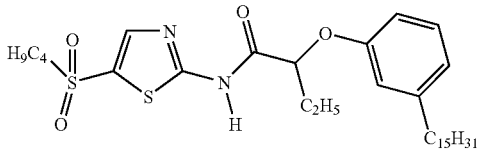
SGA8 (11.80)
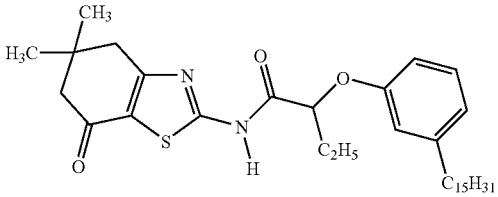
SGA9 (11.84 enol)
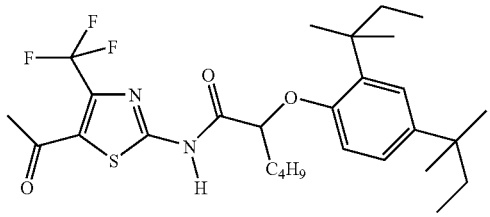
SGA10 (9.91)
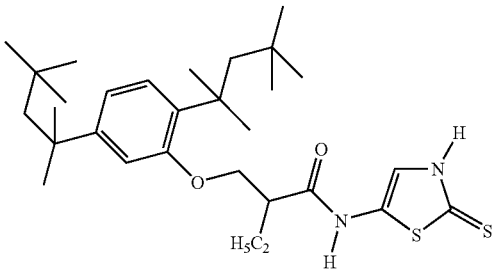
SGA11 (8.79)
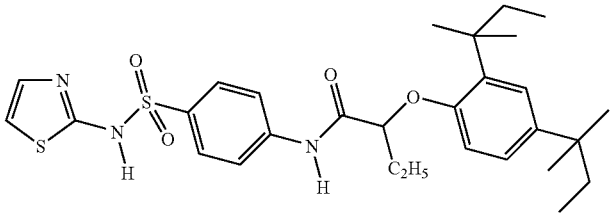
SGA12 (8.88)
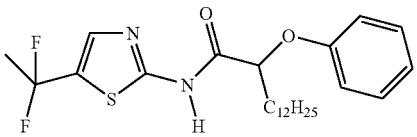
SGA13 (9.36)
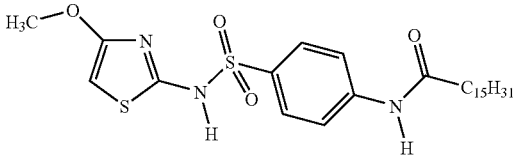
SGA14 (8.85)
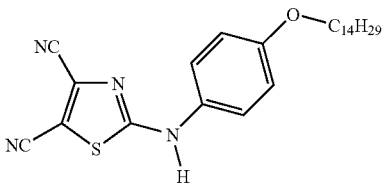
SGA15 (9.15)
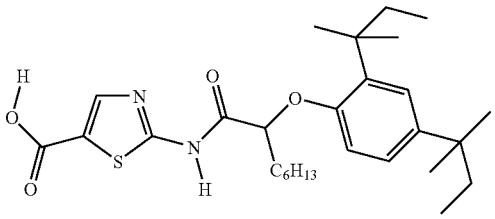
SGA16 (10.13)

-continued
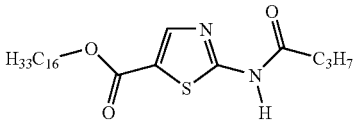
SGA17 (9.03)
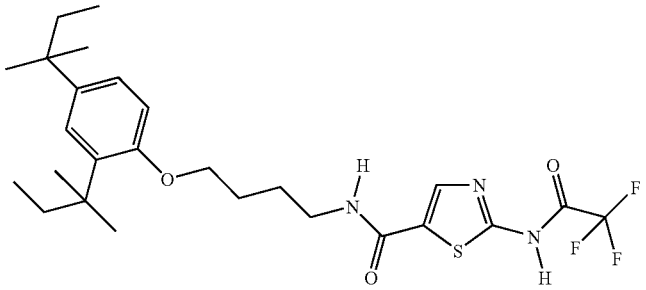
SGA18 (8.63)
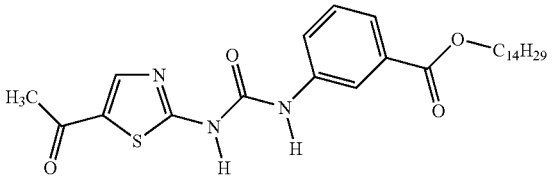
SGA19 (9.01)
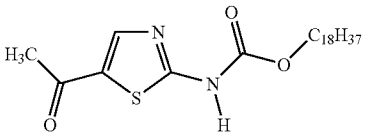
SGA20 (9.53)
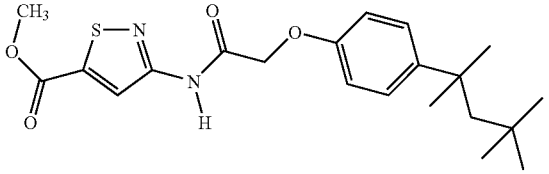
SGA21 (5.43)
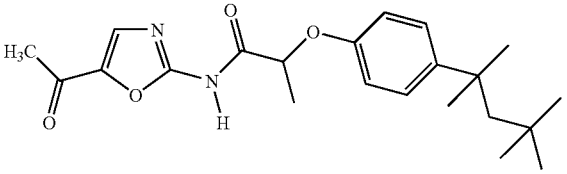
SGA22 (5.28)
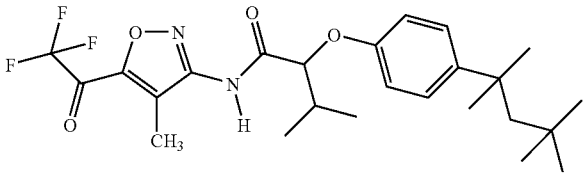
SGA23 (6.54)
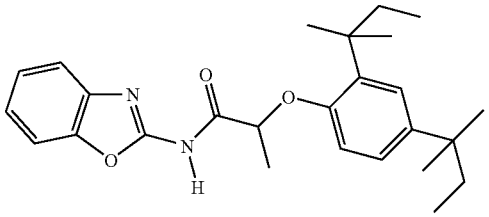
SGA24 (8.39)
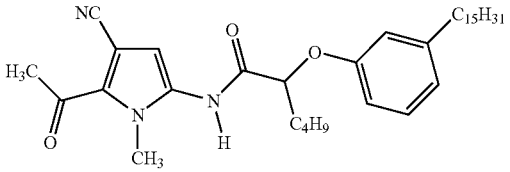
SGA25 (11.35)
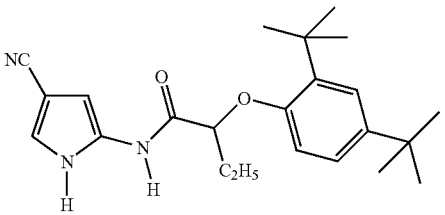
SGA26 (6.54)
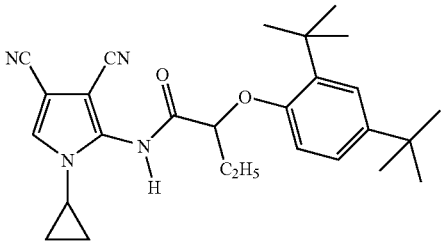
SGA27 (7.43)
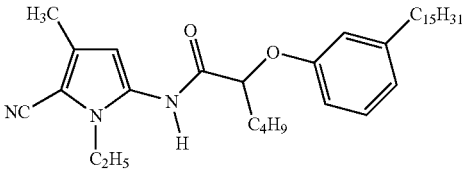
SGA28 (12.71)

-continued
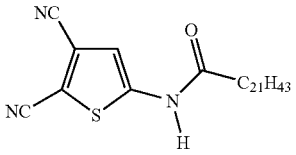
SGA29 (10.39)
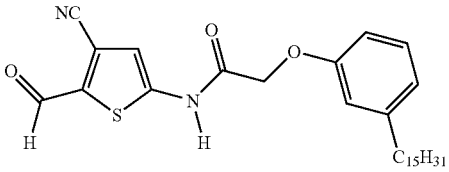
SGA30 (9.89)
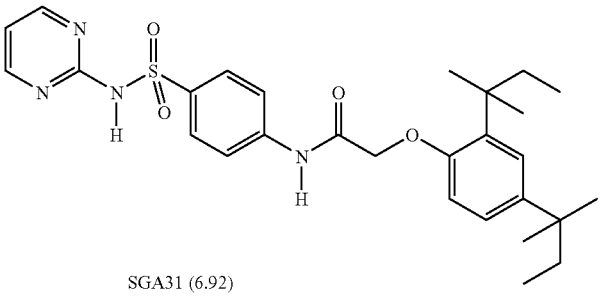
SGA31 (6.92)
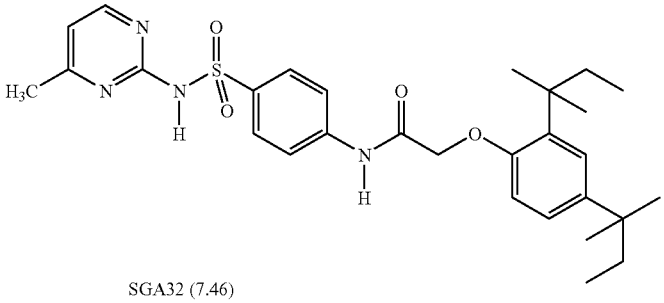
SGA32 (7.46)
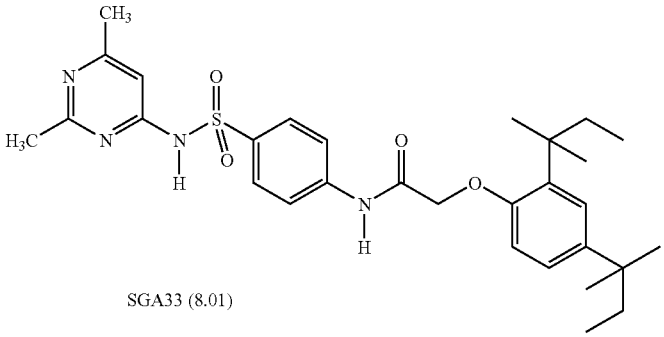
SGA33 (8.01)
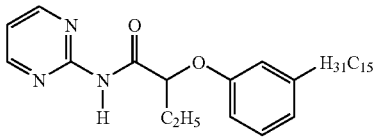
SGA34 (9.90)
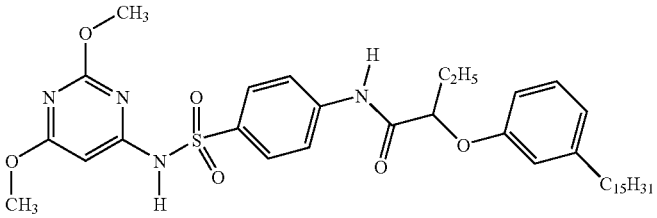
SGA35 (11.96)
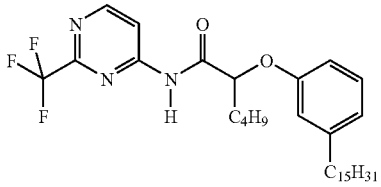
SGA36 (11.84)
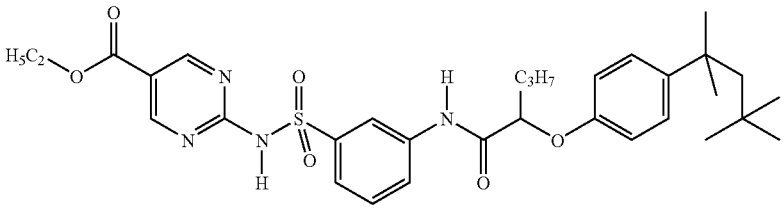
SGA37 (7.60)

-continued
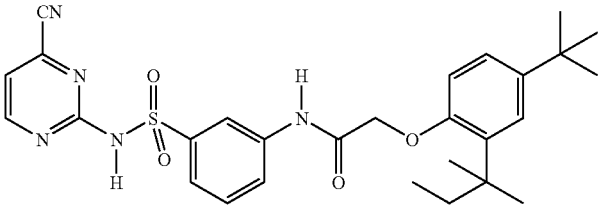
SGA38 (6.52)
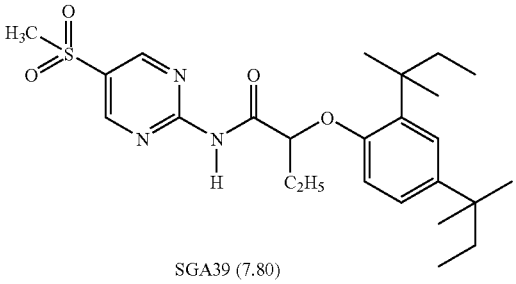
SGA39 (7.80)
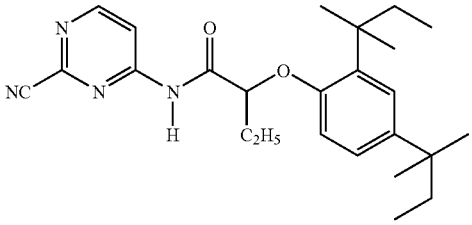
SGA40 (7.92)
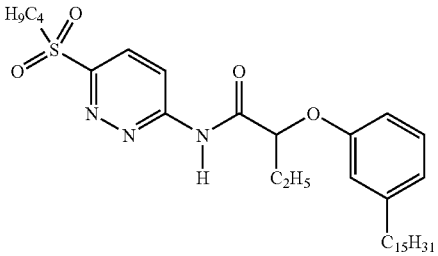
SGA41 (11.89)
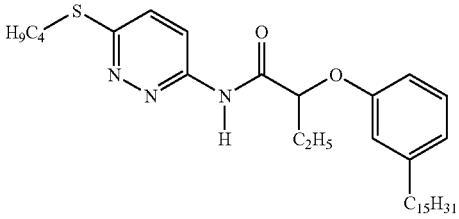
SGA42 (12.43)
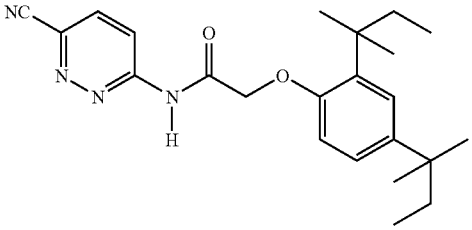
SGA43 (6.46)
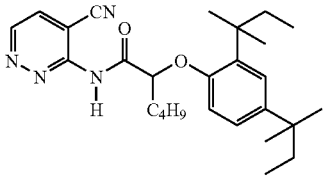
SGA44 (7.79)
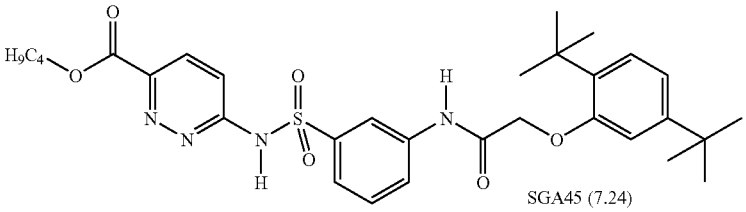
SGA45 (7.24)
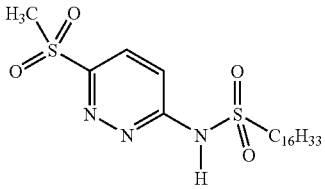
SGA46 (6.17)
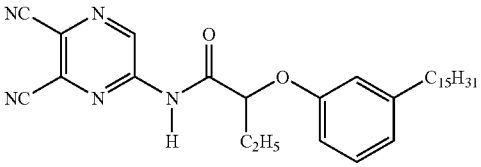
SGA47 (10.64)
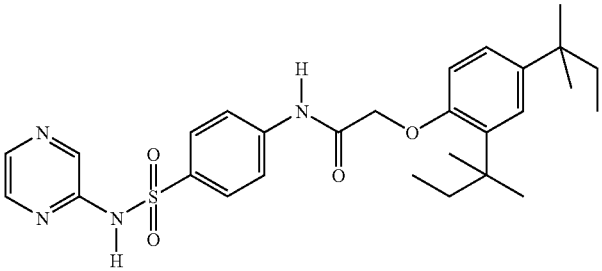
SGA48 (6.92)

-continued
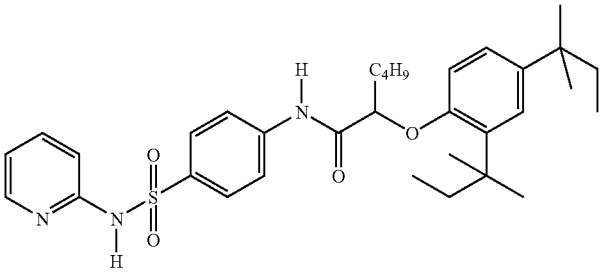
SGA49 (9.67)
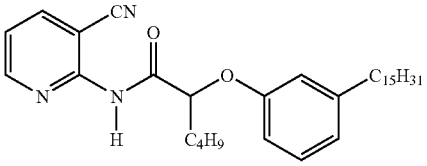
SGA50 (11.05)
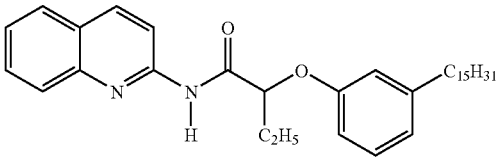
SGA51 (11.87)
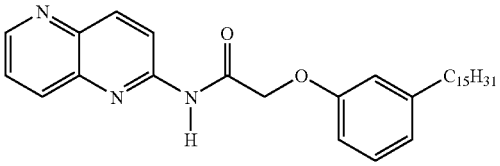
SGA52 (9.94)
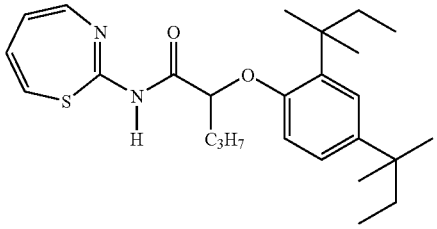
SGA53 (9.09)
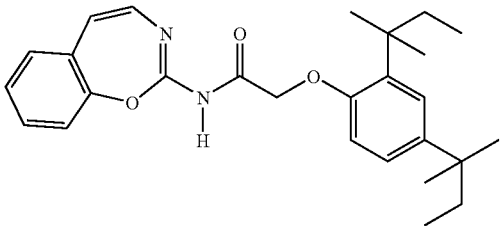
SGA54 (8.32)
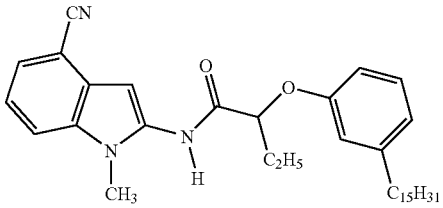
SGA55 (11.32)
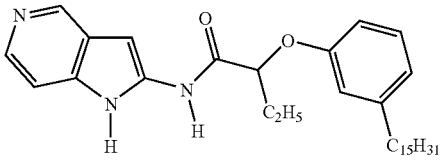
SGA56 (10.20)
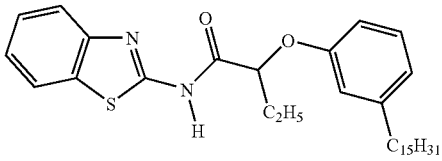
SGA57 (12.09)
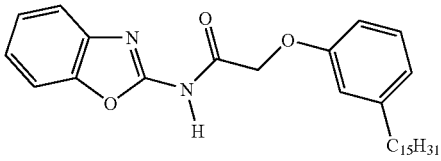
SGA58 (10.59)
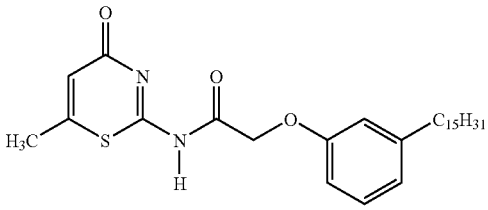
SGA59 (9.64)

-continued

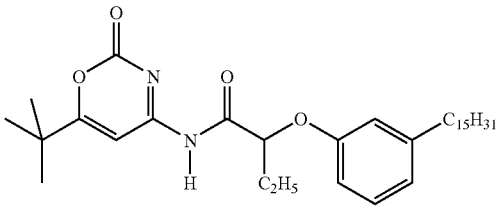

SGA60 (10.46)

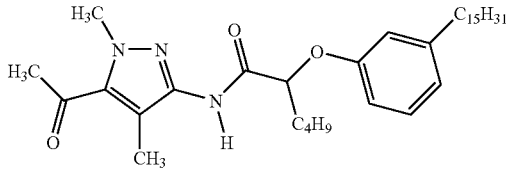

SGA61 (10.98)

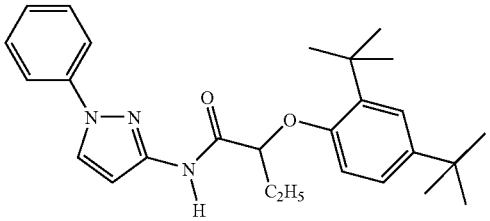

SGA62 (7.39)

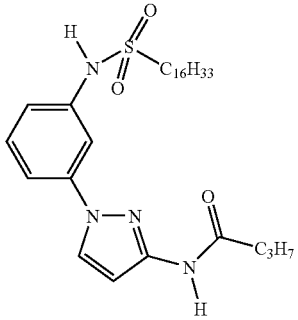

SGA63 (8.47)

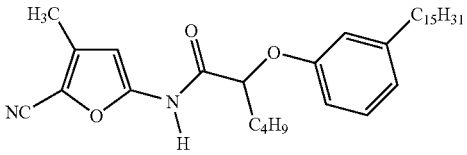

SGA64 (12.16)

For each compound useful in the invention, as the laydown is increased a threshold level is reached following which the speed improvement gradually increases with laydown, after which the improvement then levels off at a compound specific maximum level. It will be appreciated that the amount is also a function of other variables such as the location and number of layers in which the compound is located, the solvent used and film dimensions. Thus, it is desirable to have enough laydown of the compound in order to obtain the speed improvement. Sufficient laydown is required to achieve an improvement of at least 0.03, desirably 0.05 stop, more desirably at least 0.10 and even 0.25 stops or more.

Where the compound is present in a sensitized layer, the ratio of compound to silver is suitably at least 0.1 mmol of compound per mol of silver halide and, more preferably, at least 1.0 mmol of compound per mol of silver halide and, most preferably, at least 2.0 mmol per mol of silver halide. When coated in a non-silver-containing layer, the laydown of the compound is suitably at least $3\times10^{-5}$ mol/m$^2$, more preferably at least 0.0001 mol/m$^2$.

The materials useful in the invention can be added to a mixture containing silver halide before coating or be mixed with the silver halide just prior to or during coating. In either case, additional components like couplers, doctors, surfactants, hardeners and other materials that are typically present in such solutions may also be present at the same time.

The materials useful in the invention are not water-soluble and cannot be added directly to the solution. They may be added directly if dissolved in an organic water-miscible solvent such as, for example, methanol or acetone or more preferably as a dispersion. A dispersion incorporates the material in a stable, finely divided state in a lipophilic organic solvent (often referred to as a permanent solvent) that is stabilized by suitable surfactants and surface-active agents, usually in combination with a binder or matrix such as gelatin. The dispersion may contain one or more permanent solvents that dissolve the material and maintain it in a liquid state.

Some examples of suitable permanent solvents are tricresylphosphate, N,N-diethyllauramide, N,N-dibutyllauramide, p-dodecyl-phenol, dibutylphthalate, di-n-butyl sebacate, N-n-butylacetanilide, 9-octadecen-1-ol, orthomethylphenyl benzoate, trioctylanine and 2-ethylhexylphosphate. Permanent solvents can also be described in terms of physical constants such as alpha, beta and pi* as defined by M. J. Kamlet, J-L. M. Abboud, M. H. Abraham and R. W. Taft, J. Org Chem, 48, 2877(1983). The preferred permanent solvents used with the materials useful in the invention are those with Log Kow of 5.0 or greater and beta values of 0.4 or greater, more preferably 0.5 or greater. Preferred classes of solvents are carbonamides, phosphates, alcohols and esters. When a solvent is present, it is preferred that the weight proportion of compound to solvent be 1 to at least 0.5, more preferably 1 to at least 1.

The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxy-ethoxy)ethyl acetate. The dispersion may also be stabilized by addition of polymeric materials to form stable latexes. Examples of suitable polymers for this use generally contain water-solubilizing groups or have regions of high lipophobicity. Some examples of suitable dispersing agents or surfactants are Alkanol XC™ or saponin. The materials useful in the invention may also be dispersed in admixture with another component of the system, such as a coupler or an oxidized developer scavenger, so that both are present in the same oil droplet. It is also possible to incorporate the materials useful in the invention as a solid particle dispersion, i.e. a slurry or suspension of finely, mechanically ground compound. Such a solid particle dispersion may be additionally stabilized with surfactants and/or polymeric materials as known in the art. Also, additional permanent solvent may be added to the solid particle dispersion to help increase activity.

The sensitivity of the human eye is greatest to green light and so the compounds for use in the invention are most useful when located in the green record (the layer whose maximum spectral sensitivity to light is from 500 to 600 nm). The following magenta couplers are particularly beneficial when used in conjunction with the nitrogen heterocycles useful in the invention:

M-1:

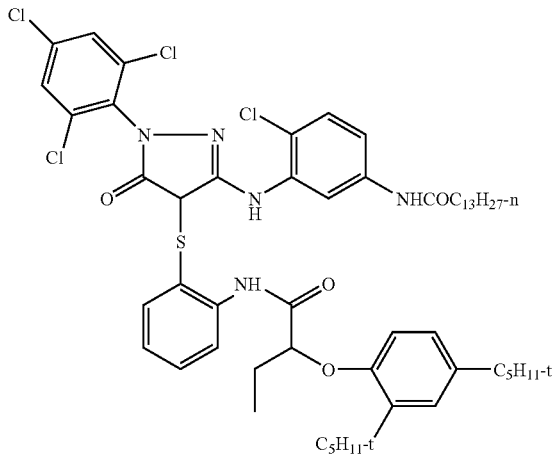

M-2:

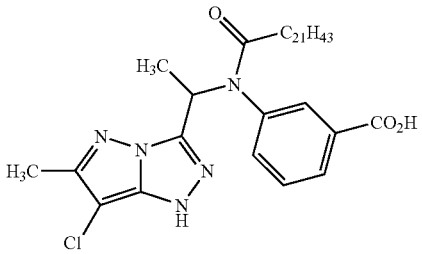

M-3:

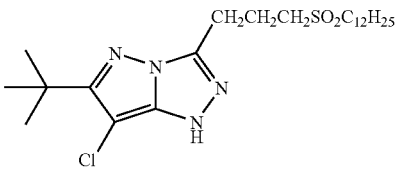

-continued

M-4:

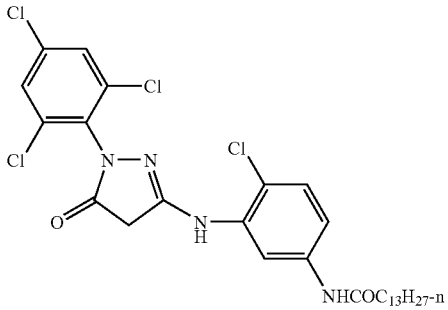

M-5:

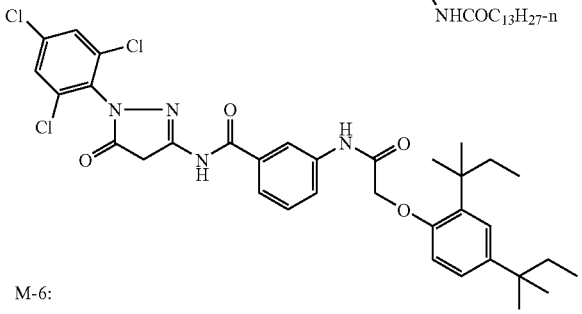

M-6:

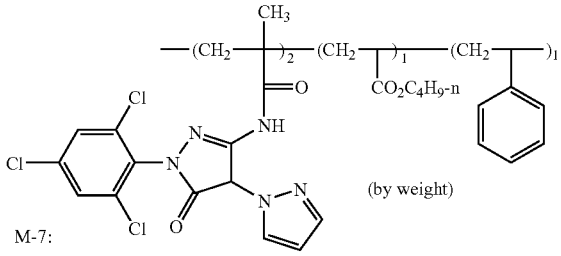

(by weight)

M-7:

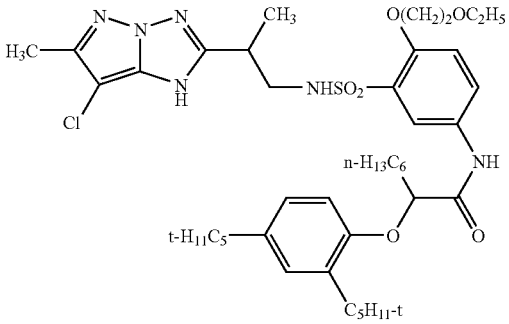

M-8:

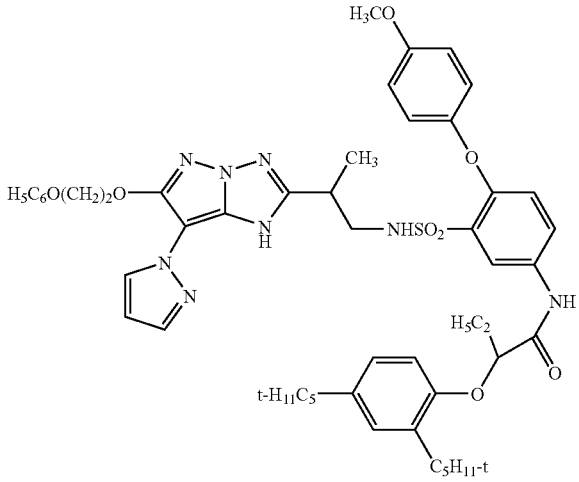

-continued
M-9:
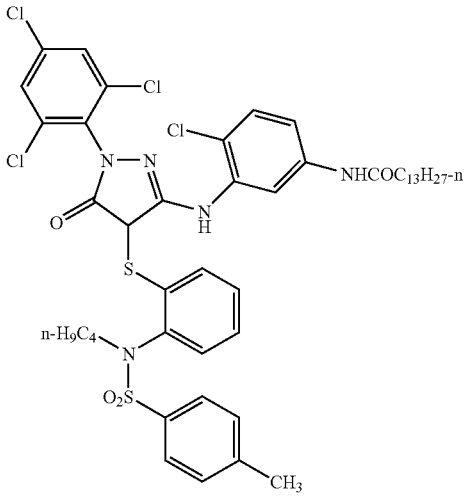
M-10:
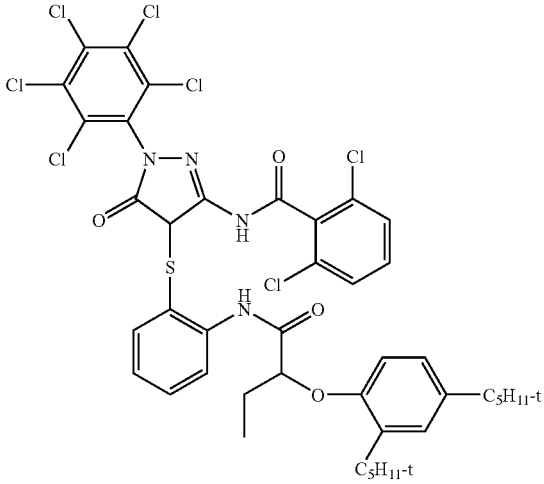
M-11:
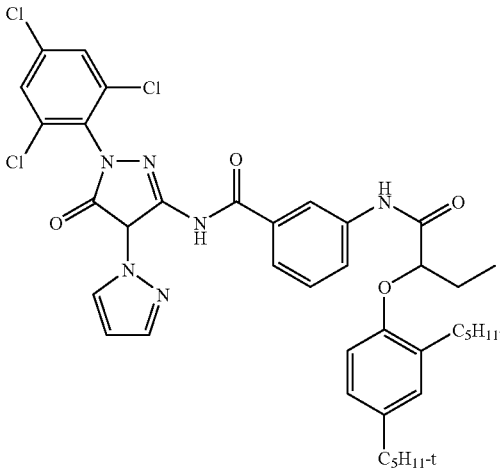
-continued
M-12:
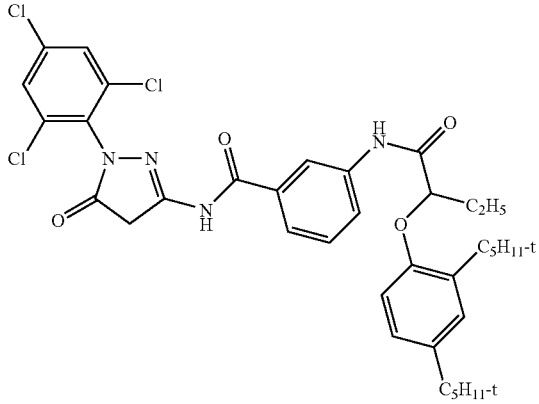
The following green sensitizing dyes are also particularly beneficial when used in combination with the nitrogen heterocycles useful in the invention:
GSD-1:
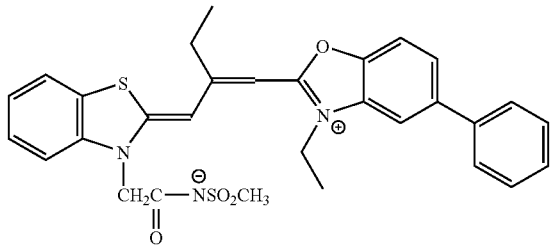
GSD-2:
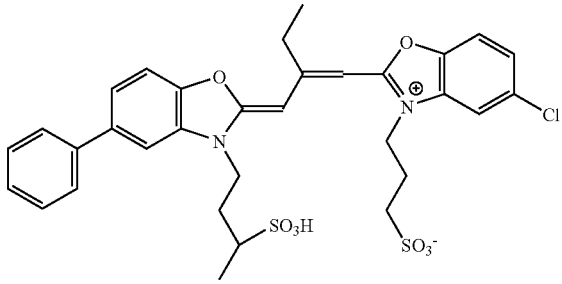
GSD-3:
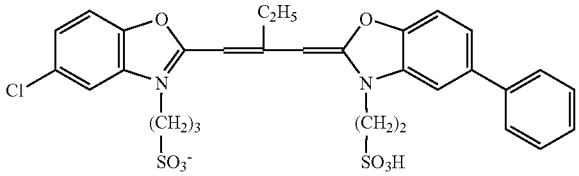
GSD-4:
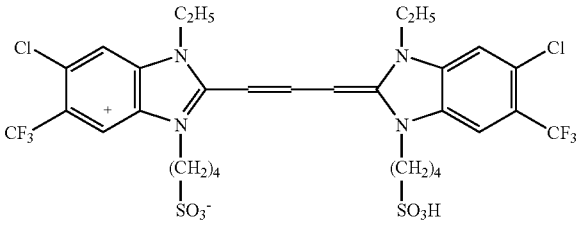

-continued
GSD-5:
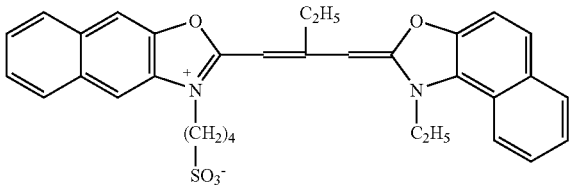
GSD-6:
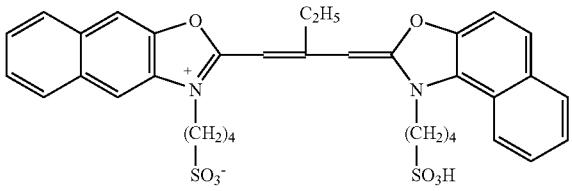
GSD-7:
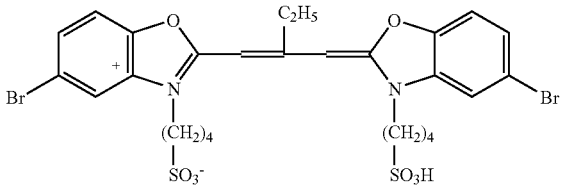
GSD-8:
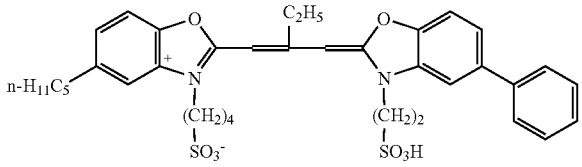
-continued
GSD-9:
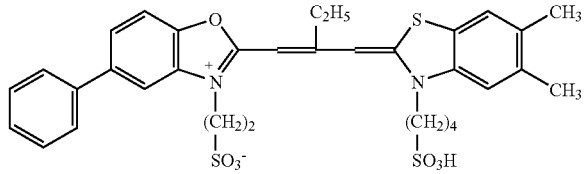
GSD-10:
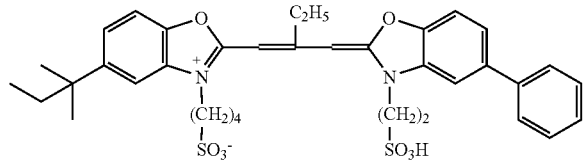
GSD-11:
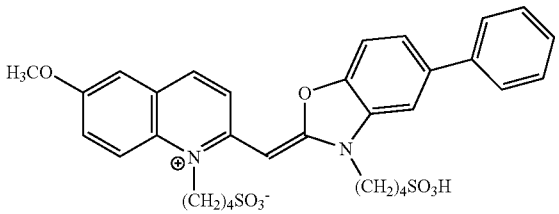
The compounds for use in the invention are also useful when located in the red record (the layer whose maximum spectral sensitivity to light is from 600 to 700 nm). The following cyan couplers are particularly beneficial when used in conjunction with the heterocycles useful in the invention:
C-3
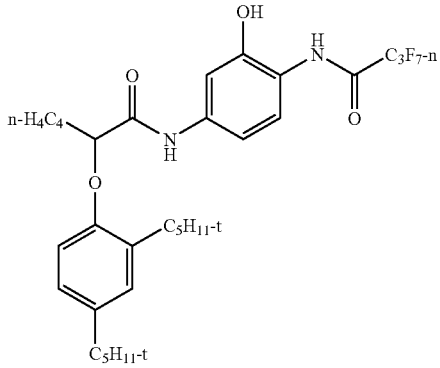

-continued
C-4
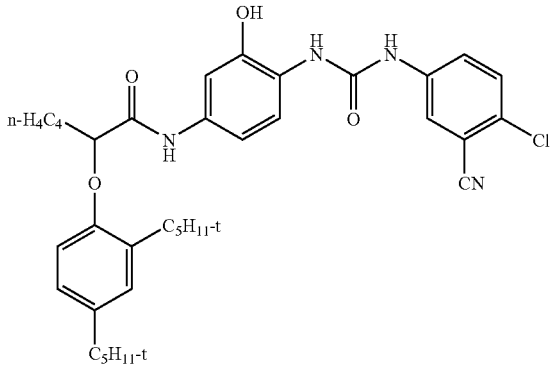
C-5
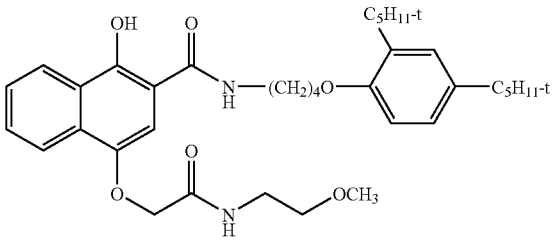
C-6
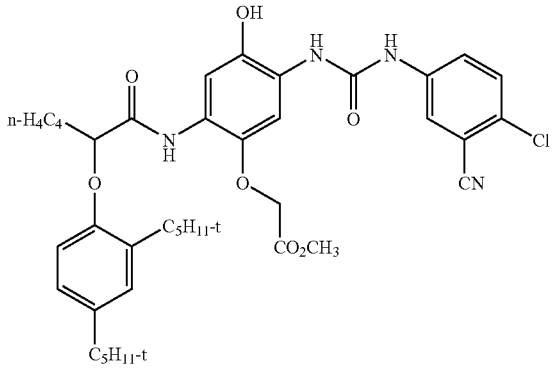
C-7
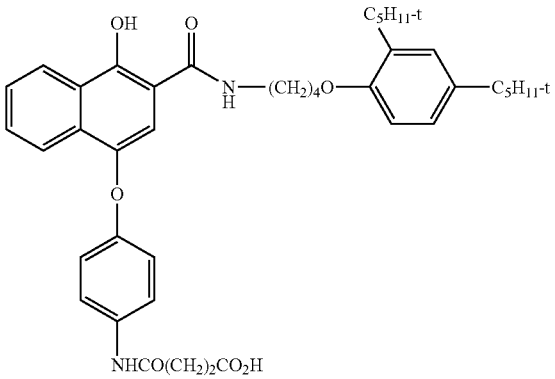

-continued
C-8
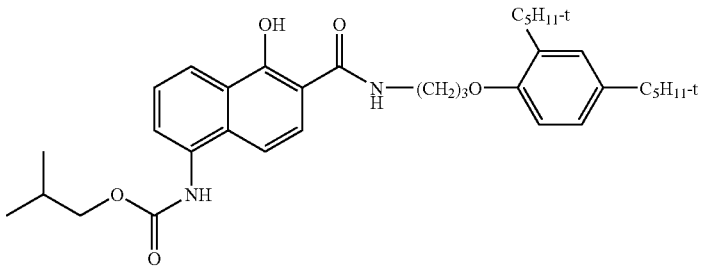
C-9
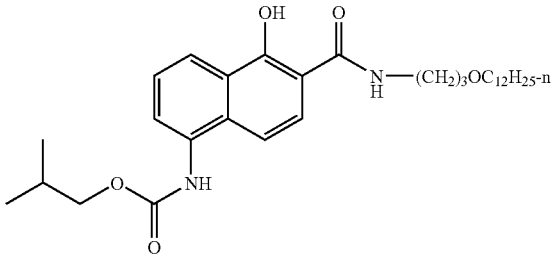
C-10
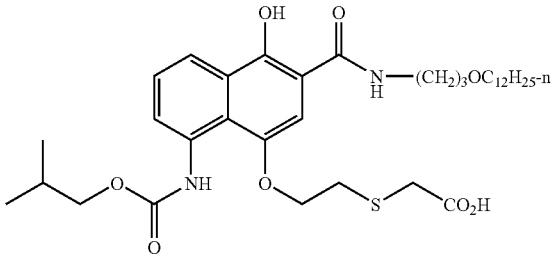
The following red sensitizing dyes are also particularly beneficial when used in combination with the heterocycles useful in the invention:
RSD-4:
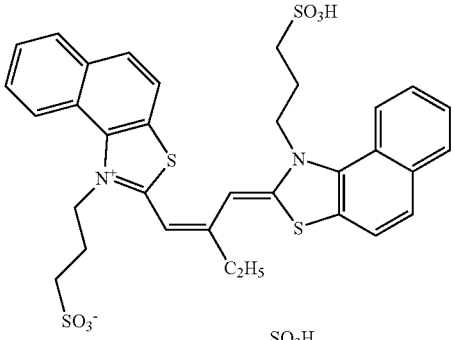
RSD-5:
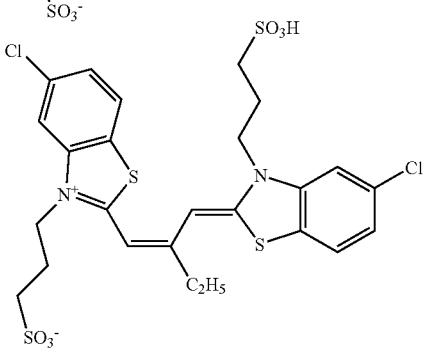
-continued
RSD-6:
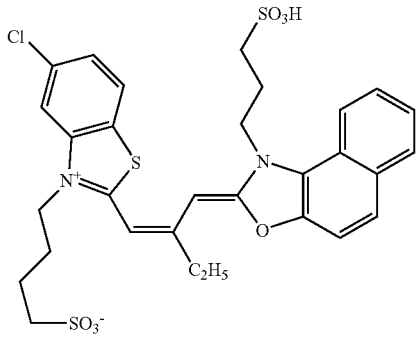
RSD-7:
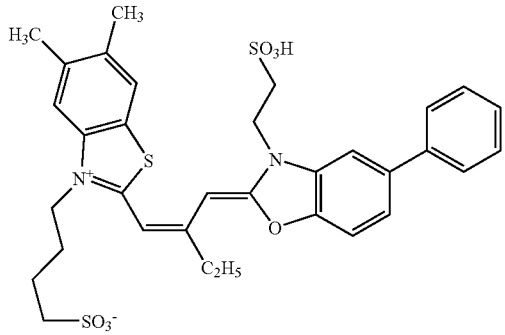

The type of light-sensitive silver halide emulsion used in the layer that contains the compound useful in the invention may be important to obtain the desired increase in light sensitivity. The silver halide emulsion is suitably a silver iodobromide emulsion, i.e. an emulsion that is low in chloride. By low in chloride it is meant that there should be present in the layer no more than 20 mol % chloride, more suitably no more than 10 mol % chloride, typically no more than 1 mol % chloride. The silver halide grains comprise at least 50, preferably 70 and optimally at least 90 mol % bromide based on silver and at least 0.01, preferably 0.5 and optimally at least 1.0 mol % iodide based on silver, with any remaining halide being chloride. Additional iodide may be incorporated to serve other functions, such as increased native blue absorption or interimage effects.

The benefit of the increase in light sensitivity is most apparent in combination with larger-sized emulsions that are associated with increased granularity. Thus, it is preferred that the compounds useful in the invention are used with emulsions that have an equivalent circular diameter of at least 0.6 μm, more preferably at least 0.8 μm, most preferably at least 1.0 μm. In addition, the benefit of the invention is greatest in origination materials, such as colour negative or colour reversal materials, since they require higher sensitivity to light (because of the variable lighting conditions in natural scenes) and low granularity (due to high magnification), relative to colour print materials for which exposure conditions are carefully controlled and which are viewed directly under low magnification conditions.

The compounds useful in the invention are also particularly useful when used in film elements that contain low overall silver levels. Thus, films containing 9 g/m$^2$ of total silver or less, or more preferably 5.4 g/m$^2$ or less or even 4.3 g/m$^2$ or less benefit from the use of such compounds.

In order to control and maintain granularity over a wide exposure range, it is a common practice to divide an individual colour record into separate layers, each containing silver halide emulsions of different degree of sensitivity to the same colour of light. While the compound for use in the invention is most useful in the most light-sensitive layer, it can be used in more than one record that is sensitive to the same colour of light to provide greater latitude of the film to large ranges of scene exposure. When two or more such sublayers exist, the most light-sensitive layer is the sublayer that responds to the lowest levels of scene exposure, unlike the other sublayers that require greater scene exposures.

For example, in a colour record, such as the green record, that is split into three layers of different relative sensitivity; fast (F), mid (M) or slow (S), the compound can be used in each layer only, or in any combination; i.e., for example, F+M, F+M+S and F+S. It is not necessary that these layers be adjacent, i.e. they may have interlayers or even imaging layers that are sensitive to other colours located between them. In addition, although the most light-sensitive layer is typically located in the film structure closest to the exposure source and farthest from the support, the compounds useful in the invention allow for alternative locations of the layers. For example, a more light-sensitive layer containing the compound useful in the invention may be located below (farther from the exposing source) than a less sensitive layer.

The preferred layer in which the compounds useful in the invention are used is the light-sensitive layer that is the most light-sensitive of two or more light-sensitive layers having the same spectral sensitivity. It is especially preferred that the most light-sensitive layer uses a silver iodobromide emulsion.

It is also possible to use the compounds useful in the invention in more than one colour record at a time. Moreover, when a number of layers of the same spectral sensitivity but of differing degrees of sensitivity to light are used, it is known that overall granularity can be minimized by using a smaller molar amount of dye-forming coupler than silver in the layers of higher sensitivity. Thus, it is preferred that the layers containing the compound useful in the invention additionally contain less than a stoichiometric amount of total dye forming coupler(s) relative to the amount of silver contained in the same layer. A suitable molar ratio of dye-forming coupler(s) to silver in the layer containing the compound useful in the invention would be less than 0.5, preferably 0.2 or even 0.1 or less.

It is known that film elements that contain silver halide emulsions in one layer that have maximum sensitivities that are separated or shifted from emulsions in other layers that are sensitive to the same colour of light are useful for increasing the amount of interimage and improving colour reproduction. For example, a layer containing an emulsion may have maximum sensitivity at ~530 nm, whereas another layer containing a different green light-sensitive emulsion may be most sensitive at ~550 nm. The layer containing the emulsions with shifted sensitivities may not contain any image couplers at all, but rather only inhibitor-releasing couplers (DIRs or DIARs (Development Inhibitor Anchiomeric Releasing-couplers)) or coloured masking couplers. The compounds for use in the invention are particularly useful therein since they allow for the improved colour reproduction while maintaining or increasing speed of the element.

The compounds useful in the invention do not tend to increase the $D_{min}$ of the emulsion layer in which they are coated. Nevertheless, it is advantageous to use these compounds in combination with any of the antifoggants or scavengers known in the art to be useful in controlling $D_{min}$ or fog. Specific examples of scavengers for oxidized developers would be 2,5-di-t-octyl-hydroquinone, 2-(3,5-bis-(2-hexyldodecylamido)benzamido)-1,4-hydroquinone, 2,4-(4-dodecyloxybenzenesulfonamido)phenol, 2,5-dihydroxy-4-(1-methylhepta-decyl)benzenesulfonic acid or 2,5-di-s-dodecylhydroquinone. Specific examples of useful antifoggants are compounds AF-1 to AF-8, whose structures are shown below, as well as 4-hydroxy-6-methyl-1,3,3a,7-tetraazaindene:

AF-1:

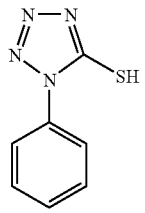

AF-2:

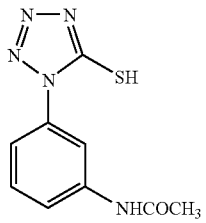

-continued

AF-3:

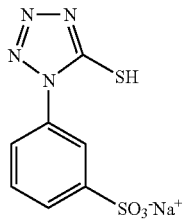

AF-4:

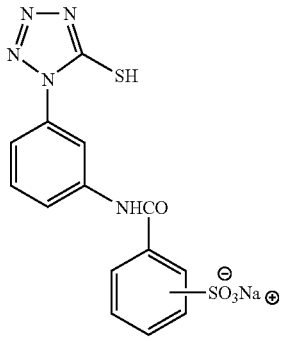

AF-5:

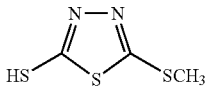

AF-6:

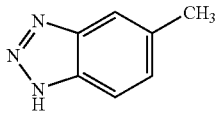

AF-7:

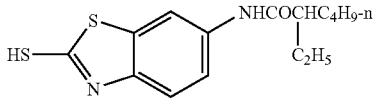

AF-8:

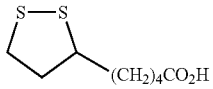

If the compounds useful in the invention have a suitable —NH group, the hydrogen may be optionally replaced with a group that is removed in a non-imagewise fashion during the development step to regenerate the original —NH group. In this case, it is the Log Kow of the unblocked compound that is important and should be calculated with the hydrogen present and without the blocking group. Any of the temporary blocking groups known in the art to decompose in the developer in a non-imagewise manner can be used for this purpose. Particularly useful are those blocking groups that rely on some specific component of the developer solution to cause decomposition and regeneration of the original substituent. One example of this kind of blocking group that relies on the hydroxylamine present in the developer is described in U.S. Pat. No. 5,019,492.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be bonded to the remainder of the molecule by an atom of carbon, silicon, oxygen, nitrogen, phosphorous, or sulfur. The substituent may be, for example halo such as chloro, bromo, iodo or fluoro; nitro; hydroxy; cyano; carboxyl; or groups which may be further substituted, such as alkyl, including straight or branched chain or cyclic alkyl, such as methyl, trifluoromethyl, ethyl, t-butyl, 3-(2,4-di-t-pentyl-phenoxy)propyl and tetradecyl; alkenyl, such as vinyl and 2-butenyl; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy and 2-dodecyl-oxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy and p-tolyloxy; carboxamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)hexanamido, alpha-(4-hydroxy-3-t-butylphenoxy)tetradecanamido, 2-oxo-1-pyrrolidinyl, 2-oxo-5-tetradecyl-1-pyrrolinyl, N-methyltetradecanamido, succinimido, phthalimido, 2,5-dioxo-1-oxazolidinyl, 3-dodecyl-2,5-dioxo-1-imidazolyl and N-acetyl-N-dodecylamino, ethoxycarbonylamino, phenoxycarbonylamino, benzyloxy-carbonylamino, hexadecyloxycarbonylamino, 2,4-di-t-butylphenoxycarbonyl-amino, phenylcarbonylamino, 2,5-(di-t-pentylphenyl)carbonylamino,p-dodecylphenylcarbonylamino, p-tolylcarbonylamino, N'-methylureido, N',N'-dimethyl-ureido, N'-methyl-N'-dodecylureido, N'-hexadecylureido , N',N'-dioctadecyl-ureido, N',N'-dioctyl-N-ethylureido, N'-phenylureido, N',N'-diphenylureido, N'-phenyl-N'-p-tolylureido, N'-(m-hexadecylphenyl)ureido, N',N'-(2,5-di-t-pentylphenyl)-N-ethylureido and t-butylcarboxamido; sulfonamido, such as methanesulfonamido, benzenesulfonamido, p-toluenesulfonamido, p-dodecyl-benzenesulfonamido, N-methyltetradecanesulfonamido, N',N'-dipropylsulfamoyl-amino and hexadecanesulfonamido; sulfamoyl, such as N-methylsulfamoyl, N-ethylsulfamoyl, N,N-dipropylsulfamoyl, N-hexadecylsulfamoyl, N,N-dimethyl-sulfamoyl, N-[3-(dodecyloxy)propyl]sulfamoyl, N-[4-(2,4-di-t-pentylphenoxy)-butyl]sulfamoyl, N-methyl-N-tetradecylsulfamoyl and N-dodecylsulfamoyl; carbamoyl, such as N-methylcarbamoyl, N,N-dibutylcarbamoyl, N-octadecyl-carbamoyl, N-[4-(2,4-di-t-pentylphenoxy)butyl]carbamoyl, N-methyl-N-tetra-decylcarbamoyl and N,N-dioctylcarbamoyl; acyl, such as acetyl, (2,4-di-t-amyl-phenoxy)acetyl, phenoxycarbonyl, p-dodecyloxyphenoxycarbonyl, methoxy-carbonyl, butoxycarbonyl, tetradecyloxycarbonyl, ethoxycarbonyl, benzyloxy-carbonyl, 3-pentadecyloxycarbonyl and dodecyloxycarbonyl; sulfonyl, such as methoxysulfonyl, octyloxysulfonyl, tetradecyloxysulfonyl, 2-ethylhexyloxy-sulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl and p-tolylsulfonyl; sulfonyloxy, such as dodecylsulfonyloxy and hexadecylsulfonyloxy; sulfinyl, such as methylsulfinyl, octylsulfinyl, 2-ethylhexylsulfinyl, dodecylsulfinyl, hexadecylsulfinyl, phenyl-sulfinyl, 4-nonylphenylsulfinyl and p-tolylsulfinyl; thio, such as ethylthio, octylthio, benzyltlio, tetradecylthio, 2-(2,4-di-t-pentylphenoxy)ethylthio, phenylthio, 2-butoxy-5-t-octylphenylthio and p-tolylthio; acyloxy, such as acetyloxy, benzoyloxy, octadecanoyloxy, p-dodecylamidobenzoyloxy, N-phenyl-carbamoyloxy, N-ethylcarbamoyloxy and cyclohexylcarbonyloxy; amino, such as phenylamino, 2-chlorophenylamino, diethylamino and dodecylamino; imido, such as N-(propanoyl)benzamnido, succinimido and 3-benzylhydantoinyl; phosphato, such as dimethylphosphato and ethylbutylphosphato; phosphono, such as diethyl and dihexylphosphono; a heterocyclic group, a heterocyclic oxy group or a heterocyclic thio group, each of which may be substituted and which contain a 3- to 7-membered heterocyclic ring composed of carbon atoms and at least one hetero atom selected from the group comprising oxygen, nitrogen and sulfur, such as 2-furyl, 2-thienyl, 2-benzimidazolyloxy or 2-benzothiazolyl; quaternary ammonio such as triethylammonio; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, lipophilic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight or polymeric backbone containing lipophilic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halo, alkoxycarbonyl, aryloxycarbonyl, carboxy, acyl, acyloxy, amino, anilino, carboxamido, carbamoyl, alkylsulfonyl, arylsulfonyl, sulfonamido and sulfamoyl groups, wherein the substituents typically contain 1 to 42 carbon atoms. Such substituents can also be further substituted.

As used herein, the term "colour photographic element" means any element containing a light-sensitive silver halide emulsion layer containing an image dye-forming coupler. They can be single colour elements or multicolour elements. Multicolour elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. A single colour element may comprise a combination of couplers in one or more common layers which upon processing together form a monocolour, including black or gray, (so-called chromogenic black and white) dye image.

A typical colour photographic element comprises a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, interlayers, overcoat layers or subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230 provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. colour negative, reversal or direct positive processing) provided with the element. Suitable emulsions and their preparation as well as methods of chemical and spectral sensitization are described in Sections I through V of *Research Disclosure*. Various additives such as UV dyes, brighteners, antifoggants, stabilizers, light absorbing and scattering materials and physical property modifying addenda such as hardeners, coating aids, plasticizers, lubricants and matting agents are described, for example, in Sections II and VI through VIII. Colour materials are described in Sections X through XI. Suitable methods for incorporating couplers and dyes, including dispersions in organic solvents, are described in Section X(E). Scan facilitating is described in Section XIV. Supports, exposure, development systems, and processing methods and agents are described in Sections XV to XX.

The information contained in the September 1994 *Research Disclosure*, Item No. 36544, is updated in the September 1996 *Research Disclosure*, Item No. 38957. Certain desirable photographic elements and processing steps, including those useful in conjunction with colour reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation or colour correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, heterooxy, sulfonyloxy, acyloxy, heterocyclyl, benzotriazoyl, sulfonamido, tetrazoylthio, benzothiazolyl-thio, 2-carboxyethylthio, phosphonyloxy, arylthio and aryldiazenyl. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized colour developing agents that are described in such representative patents and publications as: "Farbkuppler-eine Literaturübersicht," published in Agfa Mitteilungen, Band III, pp. 156-175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EP-A-0 246 616; EP-A-0 250 201; EP-A-0 271 323; EP-A-0 295 632; EP-A-0 307 927; EP-A-0 333 185; EP-A-0 378 898; EP-A-0 389 817; EP-A-0 487 111; EP-A-0 488 248; EP-A-0 539 034; EP-A-0 545 300; EP-A-0 556 700; EP-A-0 556 777; EP-A-0 556 858; EP-A-0 569 979; EP-A-0 608 133; EP-A-0 636 936; EP-A-0 651 286; EP-A-0 690 344; German OLS 4,026,903; German OLS 3,624,777 and German OLS 3,823,049. Typically such couplers are phenols, naphthols or pyrazoloazoles.

Couplers that form magenta dyes upon reaction with oxidized colour developing agent are described in such representative patents and publications as: "Farbkuppler-eine Literaturübersicht," published in Agfa Mitteilungen, Band III, pp. 126-156 (1961) as well as U.S. Pat. Nos. 2,311,082; 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EP-A-0 257 854; EP-A-0 284 240; EP-A-0 341 204; EP-A-0 347,235; EP-A-0 365,252; EP-A-0 422 595; EP-A-0 428 899; EP-A-0 428 902; EP-A-0 459 331; EP-A-0 467 327; EP-A-0 476 949; EP-A-0 487 081; EP-A-0 489 333; EP-A-0 512 304; EP-A-0 515 128; EP-A-0 534 703; EP-A-0 554 778; EP-A-0 558 145; EP-A-0 571 959; EP-A-0 583 832; EP-A-0 583 834; EP-A-0 584 793; EP-A-0 602 748; EP-A-0 602 749; EP-A-0 605 918; EP-A-0 622 672; EP-A-0 622 673; EP-A-0 629 912; EP-A-0 646 841, EP-A-0 656 561; EP-A-0 660 177; EP-A-0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265 and German OLS 40 08 067. Typically such couplers are pyrazolones, pyrazoloazoles or pyrazolobenzimidazoles that form magenta dyes upon reaction with oxidized colour developing agents.

Couplers that form yellow dyes upon reaction with oxidized colour developing agent are described in such representative patents and publications as: "Farbkuppler-eine Literaturübersicht," published in Agfa Mitteilungen; Band III; pp. 112-126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EP-A-0 327 976; EP-A-0 296 793; EP-A-0 365 282; EP-A-0 379 309; EP-A-0 415 375; EP-A-0 437 818; EP-A-0 447 969; EP-A-0 542 463; EP-A-0 568 037; EP-A-0 568 196; EP-A-0 568 777; EP-A-0 570 006; EP-A-0 573 761; EP-A-0 608 956; EP-A-0 608 957 and EP-A-0 628 865. Such couplers are typically open chain ketomethylene compounds.

Couplers that form colourless products upon reaction with oxidized colour developing agent are described in such representative patents as: UK Patent No. 861,138; U.S. Pat. Nos. 3,632,345; 3,928,041; 3,958,993 and 3,961,959. Typically such couplers are cyclic carbonyl-containing compounds that form colourless products on reaction with an oxidized colour-developing agent.

Couplers that form black dyes upon reaction with oxidized colour developing agent are described in such representative patents as U.S. Pat. Nos. 1,939,231; 2,181,944; 2,333,106 and 4,126,461; German OLS No. 2,644,194 and German OLS No. 2,650,764. Typically, such couplers are resorcinols or m-aminophenols that form black or neutral products on reaction with oxidized colour-developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343 and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" coloured couplers (e.g. to adjust levels of interlayer correction) and, in colour negative applications, with masking couplers such as those described in EP-A-0 213,490; Japanese Published Application 58-172,647; U.S. Pat. Nos. 2,983,608; 4,070,191 and 4,273,861; German Applications DE 2,706,117 and DE 2,643,965; UK Patent No. 1,530,272; and Japanese Application 58-113935. The masking couplers may be shifted or blocked, if desired.

The materials for use in the invention may be used in association with materials that release PUGs that accelerate or otherwise modify the processing steps e.g. of bleaching or fixing to improve the quality of the image. Bleach accelerator-releasing couplers, such as those described in EP-A-0 193,389; EP-A-0 301,477 and in U.S. Pat. Nos. 4,163,669, 4,865,956 and 4,923,784, may be useful. Also contemplated is use of the compositions in association with nucleating agents, development accelerators or their precursors (UK Patent Nos. 2,097,140 and 2,131,188); electron transfer agents (U.S. Pat. Nos. 4,859,578 and 4,912,025); antifogging and anticolour-mixing agents such as derivatives of hydroquinones, aminophenols, amines, gallic acid; catechol; ascorbic acid; hydrazides; sulfonamidophenols and noncolour-forming couplers.

The materials for use in the invention may also be used in combination with filter dye layers comprising yellow, cyan, and/or magenta filter dyes, either as oil-in-water dispersions, latex dispersions or as solid particle dispersions. Additionally, they may be used with "smearing" couplers (e.g. as described in U.S. Pat. Nos. 4,366,237, 4,420,556, 4,543,323 and EP-A-0 96,570). Also, the compositions may be blocked or coated in protected form as described, for example, in Japanese Application 61/258,249 or U.S. Pat. No. 5,019,492.

The materials for use in the invention may further be used in combination with image-modifying compounds that release PUGs such as "Developer Inhibitor-Releasing" compounds (DIRs). DIRs useful in conjunction with the compositions useful in the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Colour Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) that also include a timing moiety or chemical switch that produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercapto-tetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulae:

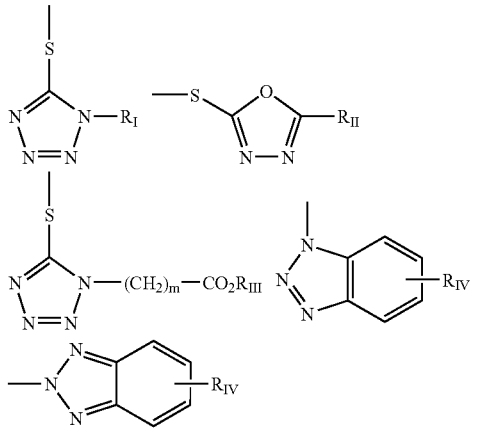

wherein $R_I$ is selected from the group comprising straight and branched alkyl groups of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group comprising hydrogen, halogen, and alkoxy, phenyl and carboxamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different colour as one associated with a different film layer. It may also be useful that the coupler moiety included in the developer inhibitor-releasing coupler forms colourless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG, such groups using an intramolecular nucleophilic substitution reaction (U.S. Pat. No. 4,248,962); groups utilizing an electron transfer reaction along a conjugated system (U.S. Pat. Nos. 4,409,323, 4,421,845 and 4,861,701, Japanese Applications 57-188035; 58-98728; 58-209736; 58-209738); groups that function as a coupler or reducing agent after the coupler reaction (U.S. Pat. Nos. 4,438,193 and 4,618,571) and groups that combine the features described above. It is typical that the timing group is of one of the formulae:

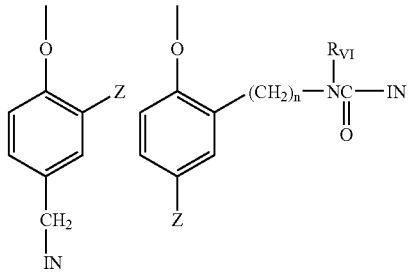

wherein IN is the inhibitor moiety, Z is selected from the group comprising nitro, cyano, alkyl- or aryl-sulfonyl; alkyl- or aryl-sulfamoyl and alkyl- or aryl-sulfonamido groups; n is 0 or 1; and $R_{VI}$ is selected from the group comprising substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP-A-0 464,612, EP-A-0 523,451, U.S. Pat. No. 4,146,396 and Japanese Kokais 60-249148 and 60-249149.

Suitable developer inhibitor-releasing couplers that may be included in photographic light sensitive emulsion layer include, but are not limited to, the following:

D1

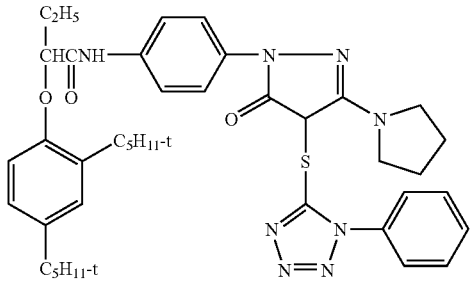

D2

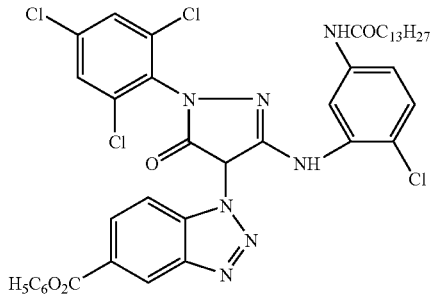

D3

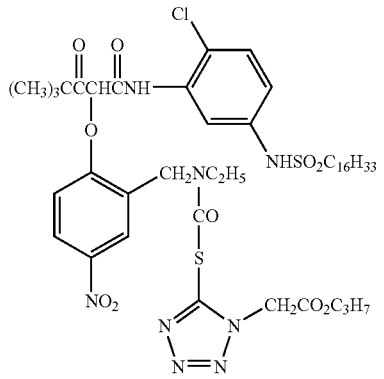

-continued

D4

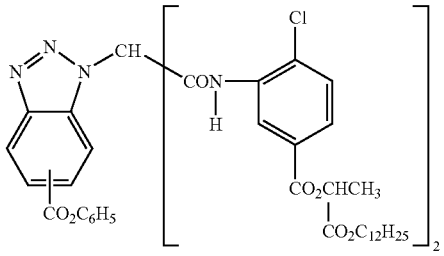

D5

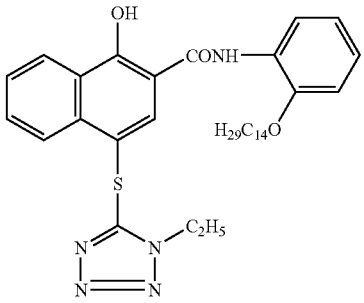

D6

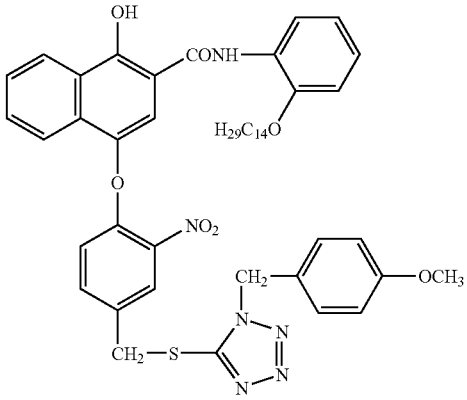

D7

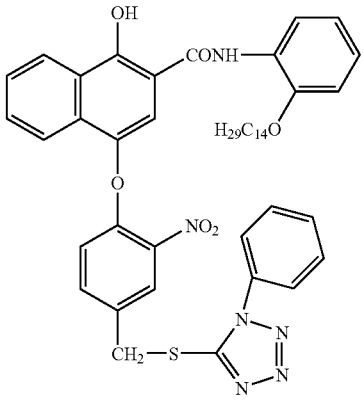

-continued

D8

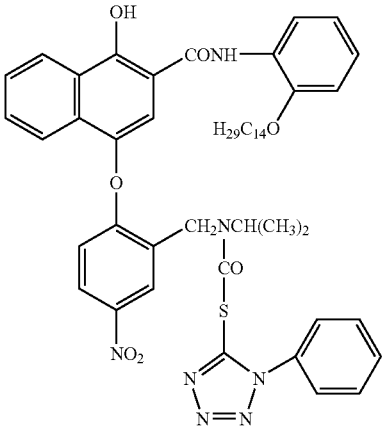

D9

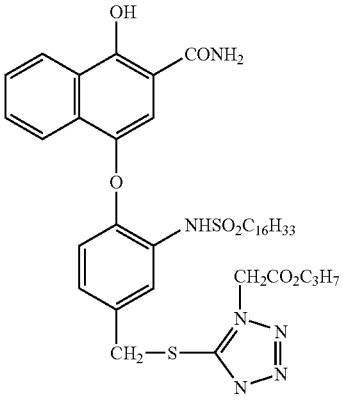

D10

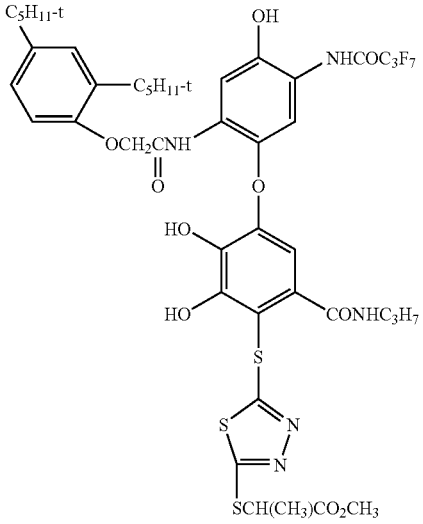

-continued

D11

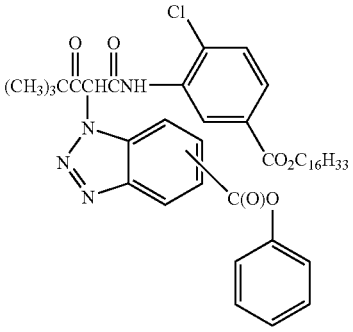

D12

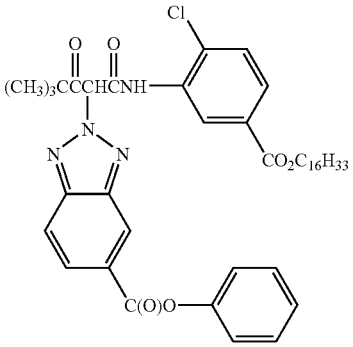

A light-sensitized silver halide emulsion layer is a sublayer of the photographic film that contains light-sensitized silver halide crystals incorporated as an emulsion in the sublayer, utilizing emulsifying agents such as, but not limited to, gelatin. Silver halide is light-sensitized by the use of sensitizing dyes that are adsorbed to the silver halide crystals and that capture scene light and initiate formation of the scene latent image silver.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). The major faces of the tabular grains can lie in either {111} or {100} crystal planes. Specifically contemplated tabular grain emulsions are those in which greater than 50% of the total projected area of the emulsion grains are accounted for by tabular grains having a thickness of less than 0.3 μm (0.5 μm for blue sensitive emulsion) and an average tabularity (T) of greater than 25 (preferably greater than 100), where the term "tabularity" is employed in its art recognized usage as $$T=\mathrm{ECD}/t^2$$

wherein ECD is the average equivalent circular diameter of the tabular grains in micrometers and t is the average thickness in micrometers of the tabular grains.

The average useful ECD of photographic emulsions can range up to about 10 μm, although in practice emulsion ECDs seldom exceed about 4 μm. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t less than 0.2 μm) tabular grains. To achieve the lowest levels of granularity it is preferred that aim tabular grain projected areas be satisfied with ultrathin (t less than 0.07 μm) tabular grains. Tabular grain thicknesses typically range down to about 0.02 μm. However, still lower tabular grain thicknesses are contemplated. For example, Daubendiek et al. U.S. Pat. No. 4,672,027 reports a 3-mol % iodide tabular grain silver bromoiodide emulsion having a grain thickness of 0.017 μm. Ultrathin tabular grain high chloride emulsions are disclosed by Maskasky in U.S. Pat. No. 5,217,858.

As noted above tabular grains of less than the specified thickness account for at least 50% of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70% of the total grain projected area. In the highest performance tabular grain emulsions, tabular grains satisfying the thickness criteria above account for at least 90% of total grain projected area.

Suitable tabular grain emulsions can be selected from among a variety of conventional teachings, such as those of the following Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions comprising predominantly silver chloride are useful and are described, for example, in U.S. Pat. Nos. 5,310,635; 5,320,938 and 5,356,764.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al, U.S. Pat. No. 4,433,048, Maskasky U.S. Pat. Nos. 4,435,501, 4,463,087 and 4,173,320, Daubendiek et al U.S. Pat. Nos.4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, 5,147,772, 5,147,773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965 and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al in U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a colour developing agent to reduce developable silver halide and oxidize the colour developing agent. Oxidized colour developing agent in turn reacts with the coupler to yield a dye.

With negative-working silver halide, the processing step described above provides a negative image. One type of such element, referred to as a colour negative film, is designed for image capture. Speed (the sensitivity of the element to low light conditions) is usually critical to obtaining sufficient image in such elements. Such elements are typically silver bromoiodide emulsions and may be processed, for example, in known colour negative processes such as the Kodak C41™ process as described in The British Journal of Photography Annual of 1988, pages 191-198. If a colour negative film element is to be subsequently employed to generate a viewable projection print as for a motion picture, a process such as the Kodak ECN-2™ process described in the H-24 Manual available from Eastman Kodak Co. may be employed to provide the colour negative image on a transparent support. Colour negative development times are typically 3 min 15 s. The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the colour development step is preceded by development with a nonchromogenic developing agent to develop exposed silver halide but not form dye and followed by uniformly fogging the element to render unexposed silver halide developable.

Such reversal emulsions are typically sold with instructions to process using a colour reversal process such as the Kodak E-6™ process. Alternatively, a direct positive emulsion can be employed to obtain a positive image.

The above emulsions are typically sold with instructions to process using the appropriate method such as the mentioned colour negative (Kodak C-41™) or reversal (Kodak E-6™) process.

Preferred colour developing agents arep-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Of the above, developers based on 4-amino-3-methyl-N-ethyl-N-(2-hydroxyethyl)aniline and 4-amino-3-methyl-N-ethyl-N-(2-methane-sulfonamidoethyl)aniline are especially preferred. Moreover, because the compounds useful in the invention give increased light sensitivity, they are especially useful in processes that have shortened development times. In particular, the film elements of the invention can be processed with development times of less than 3.25 min or even less than 3 min or in extreme cases even less than 120 s.

Development is usually followed by the conventional steps of bleaching, fixing, or bleach-fixing to remove silver or silver halide, washing and drying.

The invention will now be described with reference to the following examples which are no way to be interpreted as limiting the scope thereof.

EXAMPLES

Synthesis of Compounds of Formula (I)

Example 1

Synthesis of SGA6 a) 2-(3-Pentadecylphenoxy)butanoyl chloride.

2-(3-Pentadecylphenoxy)butanoic acid (7.8 g, 0.02 mol) (CAS Registry Number 14230-52-5) and thionyl chloride (50 ml) were heated under reflux on a steam-bath for 1 h. The resulting yellow solution was allowed to cool before being distilled under reduced pressure to leave a yellow oil. The oil was dissolved in dichloromethane (50 ml) and the solution was distilled under reduced pressure to remove volatiles. The residual 2-(3-pentadecylphenoxy)butanoyl chloride was used without further purification.

b) 2-Amino-5-formylthiazole.

2-Amino-5-formylthiazole was prepared by the method described in U.S. Pat. No. 4,225,719.

c) SGA6

2-(3-Pentadecylphenoxy)butanoyl chloride (0.2 mol) was dissolved in tetrahydrofuran (TFH) (15 ml) and the solution was added over 5 min. to a stirred solution of 2-amino-5-formylthiazole (3.0 g, 0.023 mol) in pyridine (20 ml). The mixture was stirred at room temperature for 3 h, then allowed to stand for 70 h before being poured into ice/water (100 ml) containing 10M hydrochloric acid (50 ml). The mixture was allowed to stand at room temperature for 18 h then the resulting dark red sticky solid was filtered off and washed with water. Ethyl acetate (200 ml) was added to the damp solid and the mixture was stirred at room temperature for 4 h. Insoluble material was filtered off and the filtrate was washed with water (100 ml) before being dried over magnesium sulfate. The dried solution was distilled under reduced pressure to leave a dark oil which solidified. The solid was purified by column chromatography on silica gel eluting with dichloromethane. Appropriate fractions were combined and concentrated under reduced pressure to give a yellow oil which solidified, 4.82 g. Acetonitrile (50 ml) was added to the solid and the mixture was stirred at room temperature for 18 h. The resulting pale yellow solid was filtered off, washed with acetonitrile and dried to give the title compound (Yield 4.2 g (42%)).

Example 2

Synthesis of SGA1 a) 2-Amino-5-cyanothiazole.

2-Amino-5-cyanothiazole was prepared by the method given in U.S. Pat. No. 4,324,899.

b) SGA1

2-(3-Pentadecylphenoxy)butanoyl chloride (0.11 mol, prepared as described in Example 1) was dissolved in THF (10 ml) and the solution was added over 30 min. to a stirred solution of 2-amino-5-cyanothiazole (1.5 g, 0.012 mol) in pyridine (20 ml). The mixture was stirred at room temperature for 20 h, then distilled under reduced pressure. 3M Hydrochloric acid (50 ml) was added to the residue and the mixture was stirred at room temperature for 2 h, then the resulting dark solid was filtered off and washed with water. The damp solid was dissolved in ethyl acetate (100 ml) and the solution was washed with water (50 ml). The ethyl acetate solution was dried over magnesium sulfate before it was distilled under reduced pressure to leave a dark oil, 6.0 g. The oil was purified by column chromatography equipment, eluting with mixtures of ethyl acetate and 60-80 petroleum-ether in ratios of 0:100, 10:90, 20:80 and 25:75%. A pale yellow oil was obtained which soon solidified. The solid was recrystallised from a mixture of ethyl acetate (40 ml) and acetonitrile (40 ml) to give the title compound (Yield 3.25 g (56%)).

Example 3

Synthesis of SGA7 a) 2-Amino-5-butylthiothiazole.

A mixture of 2-amino-5-bromothiazole hydrobromide (13.0 g, 0.05 mol, available from Acros Organics) and 1-butanethiol (4.5 g, 0.05 mol) in ethanol (50 ml) was heated under reflux on a steam-bath for 30 h. The mixture was then allowed to stand at room temperature for 18 h before being distilled under reduced pressure. Water (25 ml) was added to the residue followed by the cautious addition of 0.88 ammonia (25 ml). The mixture was stirred at room temperature for 4 h, then the resulting beige solid was filtered off, washed with water and dried to give 2-amino-5-butylthiothiazole, (Yield 6.0 g (63%)).

b) SGA7

2-(3-Pentadecylphenoxy)butanoyl chloride (0.29 mol, prepared as described in Example 1) was dissolved in THF (15 ml) and the solution was added over 15 min. to a stirred solution of 2-amino-5-butylthiothiazole (6.0 g, 0.032 mol) in pyridine (20 ml). The mixture was stirred at room temperature for 3 h then it was allowed to stand for 18 h before being distilled under reduced pressure. Ice/water (50 ml) and 3M hydrochloric acid (50 ml) were added to the residue and the mixture was stirred at room temperature for 4 h, during which time the oil obtained initially turned solid. The solid was filtered off and washed with water then it was dissolved in ethyl acetate (100 ml). The solution was washed with water (50 ml), dried over magnesium sulfate and then concentrated under reduced pressure to leave a dark yellow oil which soon solidified, 16.05 g. 4.0 g of the solid was purified by column chromatography on silica gel eluting with dichloromethane. Appropriate fractions were combined and distilled under reduced pressure to leave a pale pink oil which solidified to give the title compound (Yield 3.78 g (91% based on the 4.0 g taken for purification)).

Example 4

Synthesis of SGA8

70-75% m-Chloroperoxybenzoic acid (2.29 g, ca. 0.01 mol, (available from Acros Organics) was added to a stirred solution of SGA7 (5.6 g, 0.01 mol, as prepared above) in dichloromethane (50 ml) and the mixture was stirred at room temperature for 22 min. More m-chloroperoxybenzoic acid (2.29 g, ca. 0.01 mol) was added and stirring was continued. The reaction was monitored by tlc analysis and, after the addition of one equivalent of peracid, mainly sulfoxide was formed. After two equivalents had been added the sulfoxide began to be converted into sulfone. Three further portions of m-chloroperoxybenzoic acid (0.33 g, ca. 0.0015 mol) were added at intervals of 81 min., 23 min. and 111 min. after the previous additions. When tlc showed that all the sulfoxide had been converted into sulfone, after a total stirring time of about 6 h, more dichloromethane (50 ml) was added. The mixture was washed cautiously with 5% aqueous sodium bicarbonate solution (75 ml), then the dichloromethane layer was separated off and dried over magnesium sulfate. The dried solution was distilled under reduced pressure to give a yellow oil, which soon solidified. The solid was purified by column chromatography on silica gel eluting with dichloromethane. Appropriate fractions were combined and distilled under reduced pressure to give a colourless oil which solidified to give the title compound (Yield 5.16 g (87%)) as a white powder.

Example 5

Synthesis of SGA32 a) 2-(2,4-Di-t-pentylphenoxy)ethanoyl chloride.

2-(2,4-Di-t-pentylphenoxy)ethanoic acid (CAS Registry Number 13402-96-5) (11.05 g, 0.038 mol) and thionyl chloride (50 ml) were heated under reflux on a steam-bath for 1.5 h. The resulting yellow solution was allowed to cool before being distilled under reduced pressure. The residue was dissolved in 60-80 petroleum-ether (200 ml) and the solution was distilled under reduced pressure to remove volatiles, leaving 2-(2,4-di-t-pentylphenoxy)ethanoyl chloride as a red oil which was used without further purification.

b) SGA32

A solution of 2-(2,4-di-t-pentylphenoxy)ethanoyl chloride (0.038 mol) in THF (50 ml) was added dropwise to a solution of sulfamerazine (10.0 g, 0.038 mol, available from Sigma Chemicals) in pyridine (20 ml) at room temperature and the resulting orange suspension was stirred at room temperature for 18 h. The reaction mixture was poured into water (1500 ml) containing 10M hydrochloric acid (200 ml) to give a solid. The solid was filtered off, washed with water and dried, then recrystallized twice from a mixture of acetonitrile and ethyl acetate to yield the title compound as a white powder (Yield 10.5 g, 52%).

Example 6

Synthesis of SGA42 a) 2-Amino-6-chloropyridazine

2-Amino-6-chloropyridazine was made by the method given in J. Org. Chem., 1984, 49, 2240.

b) 2-(3-Pentadecylphenoxybut-1-anoyl)amino-6-chloropyridazine.

A solution of 2-(3-Pentadecylphenoxy)butanoyl chloride (9.35 g, 0.0229 mol, prepared as described in Example 1) THF (30 ml) was added dropwise over 20 min. to a stirred mixture of 2-amino-6-chloropyridazine (3.00 g, 0.0232 mol), 2,6-lutidine (2.48 g, 0.0232 mol) and 4-(dimethylamino)pyridine (catalytic amount) in THF (200 ml), cooled using an ice/acetone-bath. The reaction was stirred at room temperature for 19 h then the solvent was removed in vacuo and the residue taken-up in a mixture of dilute hydrochloric acid (100 ml) and ethyl acetate (150 ml). The organic solution was washed with saturated sodium hydrogen carbonate solution (100 ml), dried over magnesium sulfate and distilled under reduced pressure. The residual oil was purified by column chromatography over silica eluting initially with 60-80 petroleum-ether and finally with 4:1 60-80 petroleum-ether/ethyl acetate. The resulting oil was crystallised from butyronitrile (50 ml). The resulting white solid was removed by filtration and dried at oil-pump vacuum to give 2-(3-pentadecylphenoxybut-1-anoyl)amino-6-chloropyridazine, (Yield 3.90 g (33%)).

c) 2-(3-Pentadecylphenoxybut-1-anoyl)amino-6-mercaptopyridazine.

A suspension of thiourea (0.59 g, 0.0776 mol) and 2-(3-pentadecyl-phenoxybut-1-anoyl)amino-6-chloropyridazine (3.90 g, 0.0778 mol) in ethanol (15 ml) was heated at reflux for 4 h. The reaction was allowed to cool and the resulting solid was removed by filtration and dried at oil-pump vacuum/40 C. This gave 2-(3-pentadecylphenoxybut-1-anoyl)amino-6-mercaptopyridazine as a yellow solid, (Yield 2.80 g (72%)).

d) SGA42

Potassium t-butoxide (0.63 g, 0.0563 mol) was added to a stirred suspension of 2-(3-pentadecylphenoxybut-1-anoyl) amino-6-mercaptopyridazine (2.80 g, 0.0561 mol) in a mixture of THF (15 ml) and ethanol (20 ml). The suspension was stirred until the solid had dissolved to form a cloudy solution and then 1-iodobutane (1.04 g, 0.0565 mol) was added. The reaction mixture was stirred for 2 h then the solvent was removed in vacuo and the residue was taken-up in a mixture of dilute hydrochloric acid (100 ml) and ethyl acetate (100 ml). The organic solution was dried over magnesium sulfate and concentrated in vacuo. The resulting oil was purified by column chromatography over silica gel, eluting initially with 60-80 petroleum-ether and finally with 6:1 60-80 petroleum-ether/ethyl acetate. This produced an oil which solidified upon standing to give the title compound (Yield 2.20 g (71%)).

Example 7

Synthesis of SGA41

70% m-Chloroperbenzoic acid (0.98 g, 0.0398 mol) was added to a stirred solution of SGA42 (2.20 g, 0.0396 mol) in dichloromethane (15 ml). The solution was stirred for 15 min. over which time a solid precipitated. A further portion of m-chloroperbenzoic acid (0.97 g, 0.0394 mol) was added and the reaction mixture was stirred for a further 20 min. The mixture was diluted with dichloromethane (100 ml) and washed with saturated sodium hydrogen carbonate solution (100 ml), then the organic solution was dried over magnesium sulfate and concentrated in vacuo. The residual solid was recrystallised twice from butyronitrile (20 ml) to give the title compound as a white solid (Yield 0.64 g (28%)).

Photographic Examples

Multilayer films demonstrating the principles of this invention were produced by coating the following layers on a cellulose triacetate film support (coverage are in g/m$^2$, emulsion sizes as determined by the disc centrifuge method and are reported in diameter×thickness in micrometers). Surfactants, coating aids, emulsion addenda (including 4-hydroxy-6-methyl-1,3,3a,7-tetra-azaindene), sequestrants, thickeners, lubricants, matte and tinting dyes were added to the appropriate layers as is common in the art. Formulae for the identified compounds are provided at the end of these examples.

Layer 1 (Antihalation layer): gelatin at 1.08, colloidal gray silver at 0.150; ILS-1 at 0.097; DYE-1 at 0.029; DYE-2 at 0.065; DYE-3 at 0.021; CH-1 at 0.025 and UV-1 at 0.075.

Layer 2 (Slow cyan layer): a blend of two red-sensitized (all with a mixture of RSD-1 and RSD-2) tabular silver iodobromide emulsions: (i) 0.81×0.11 μm, 4.5 mol % I at 0.400, (ii) 0.62×0.111 μm, 4.1 mol % iodide at 0.175; cyan dye-forming couplers C-1 at 0.248 and C-2 at 0.236; bleach accelerator-releasing coupler B-1 at 0.086; image-modifier DIR-1 at 0.032; OxDS-1 at 0.010 and gelatin at 1.08.

Layer 3 (Mid cyan layer): a red-sensitized (with a mixture of RSD-1 and RSD-2) iodobromide tabular emulsion (1.44×0.13 μm, 3.7 mol % I) at 0.572; C-1 at 0.265; C-2 at 0.103; B-1 at 0.011; DIR-2 at 0.043; masking coupler MC-1 at 0.022 and gelatin at 1.08.

Layer 4 (Fast cyan layer): a red-sensitized (with a mixture of RSD-1, RSD-2 and RSD-3) iodobromide tabular emulsion (2.41×0.13 μm, 3.7 mol % I) at 1.286; C-1 at 0.163; DIR-2 at 0.0.054; B-1 at 0.008 and gelatin at 1.08.

Layer 5 (Ultra-fast cyan layer): a red-sensitized (with a mixture of RSD-1, RSD-2 and RSD-3) iodobromide tabular emulsion (3.87×0.13 μm, 3.7 mol % I) at 1.180; C-2 at 0.175; DIR-3 at 0.060; DIR-4 at 0.001 and gelatin at 1.08.

Layer 6 (Interlayer): ILS-1 at 0.075 and gelatin at 1.08.

Layer 7 (Slow magenta layer): a blend of two green-sensitized (both with a mixture of GSD-1 and GSD-2) silver iodobromide tabular emulsions: (i) 1.17×0.12 μm, 4.5 mol % iodide at 0.156 and (ii) 0.62×0.111 μm, 2.6 mol % iodide at 0.573; magenta dye-forming coupler M-1 at 0.300; MC-2 at 0.090, DIR-5 at 0.032, ILS-1 at 0.011 and gelatin at 1.400.

Layer 8 (Mid magenta layer): a blend of two green-sensitized (both with a mixture of GSD-1 and GSD-2) silver iodobromide tabular emulsions: (i) 2.46×0.13 μm, 3.7 mol % iodide at 0.534 and (ii) 1.45×0.13 μm, 3.7 mol % iodide at 0.370; M-1 at 0.089; MC-2 at 0.086; DIR-5 at 0.025, ILS-1 at 0.012 and gelatin at 1.438.

Layer 9 (Fast magenta layer): two parts mixed together at a 1:1 ratio just prior to coating; Part A (dispersion melt): M-1 at 0.104; DIR-5 at 0.011; ILS-1 at 0.014 and gelatin at 0.420 and Part B (emulsion melt): a green-sensitized (with a mixture of GSD-1 and GSD-2) silver iodobromide tabular emulsion (2.90×0.13 μm, 3.7 mol % iodide) at 1.240; MC-2 at 0.021; DIR-6 at 0.003 and gelatin at 1.076.

Layer 10 (Interlayer): ILS-1 at 0.182 and gelatin at 0.700.

Layer 11 (Slow yellow layer): a blend of three blue-sensitized (all with BSD-1 and BSD-2) tabular silver iodobromide emulsions (i) 2.41×0.1 μm, 2.0 mol % I at 0.402, (ii) 1.02×0.137 μm, 2.0 mol % I at 0.136, (iii) 0.62×0.111 μm, 2.6 mol % I at 0.505; yellow dye-forming coupler Y-1 at 0.850; DIR-1 at 0.022; DIR-7 at 0.038; B-1 at 0.009 and gelatin at 1.90.

Layer 12 (Fast yellow layer): a blue-sensitized (with BSD-1 and BSD-2) tabular silver iodobromide emulsion, 3.72×0.131 μm, 3.7 mol % I at 0.070 and a blue-sensitized (with BSD-1) 3-D silver iodobromide emulsion, 1.21 μM diameter), 9.7 mol % I at 1.055; Y-1 at 0.312; DIR-7 at 0.065; B-1 at 0.011, stabiliser S-1 at 0.008 and gelatin at 1.280.

Layer 13 (WV Filter Layer): silver bromide Lippman emulsion at 0.215; UV-1 and UV-2 both at 0.108 and gelatin at 0.700.

Layer 14 (Protective overcoat): gelatin at 0.888 and bis (vinylsulfonyl)methane hardener at 1.75% of total gelatin weight.

All comparative and heterocyclic compounds for use in the invention were dispersed in twice their own weight in N,N-dibutyllauramide, unless otherwise noted. The resulting dispersions were stirred at 40 C for at least 1 h before coating. Comparative or samples of the invention had the test compound added at 0.0806 mmol/m$^2$ to Part A of Layer 9.

Formulae for materials used in the above formats are as follows:

ILS-1:

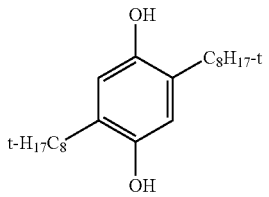

-continued
DYE-1:
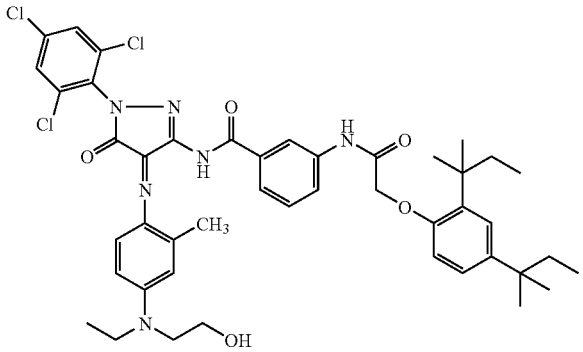
DYE-2:
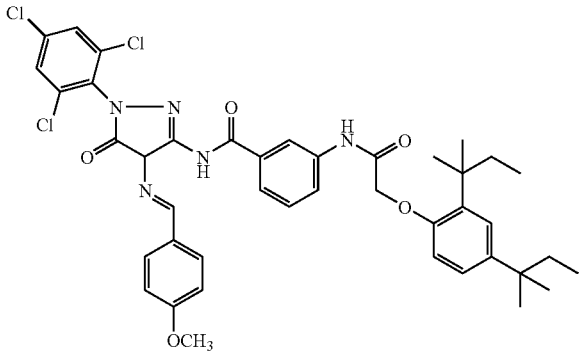
DYE-3:
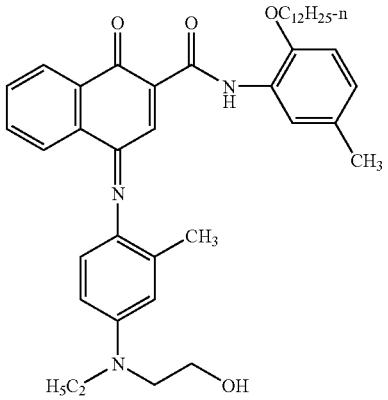
CH-1:
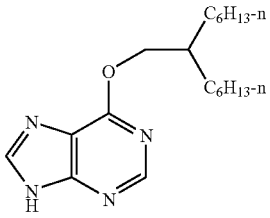
UV-1:
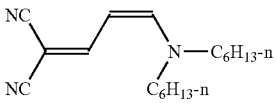
-continued
C-1:
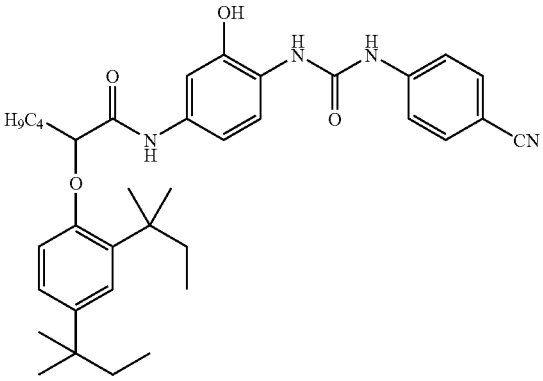
C-2:
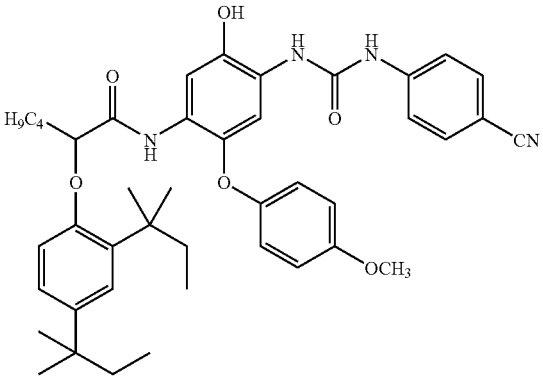
B-1:
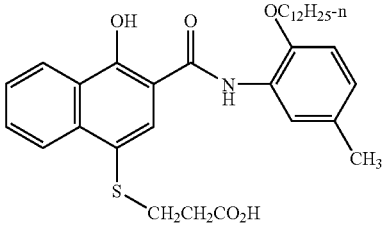
DIR-1:
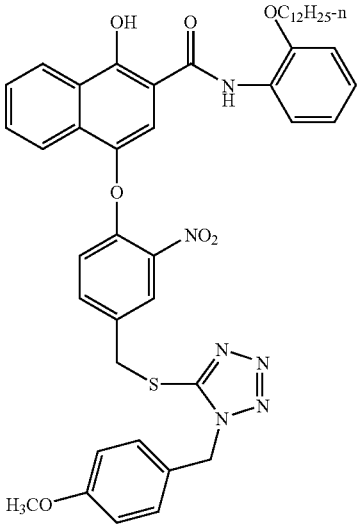

-continued
OxDS-1:
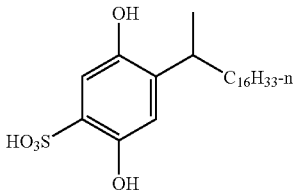
DIR-2:
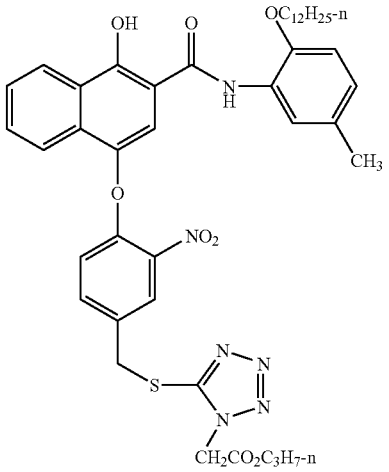
MC-1:
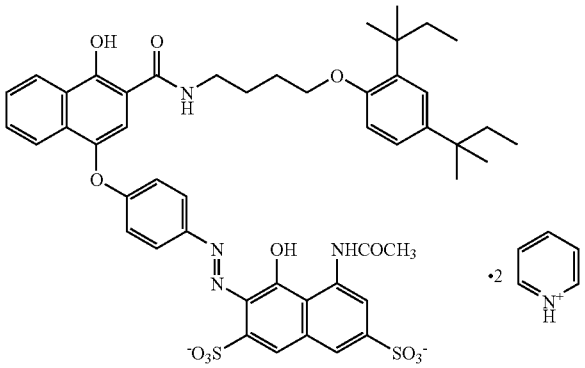
DIR-3:
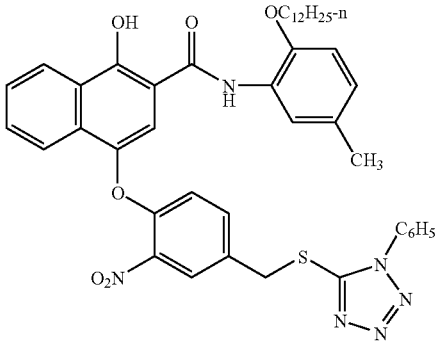
-continued
DIR-4:
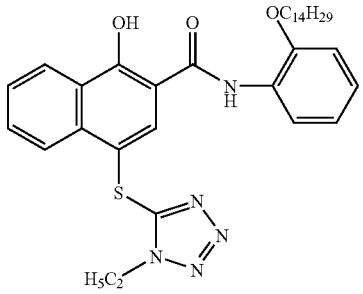
M-1:
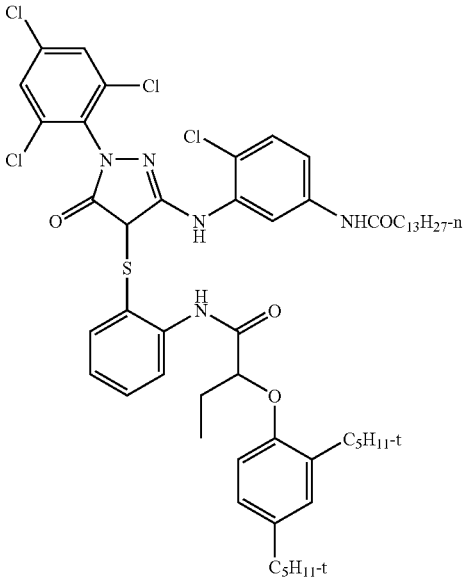
MC-2:
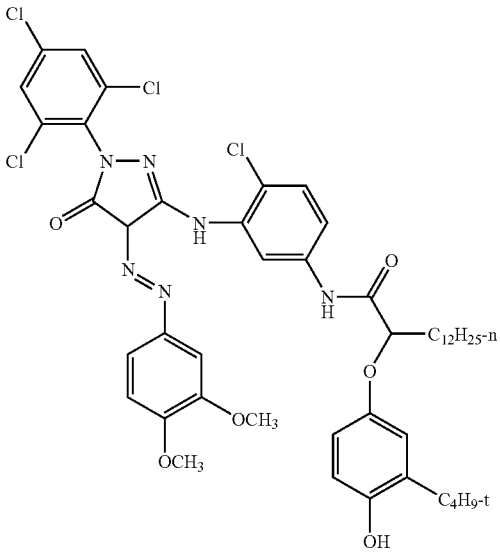

-continued
DIR-5:
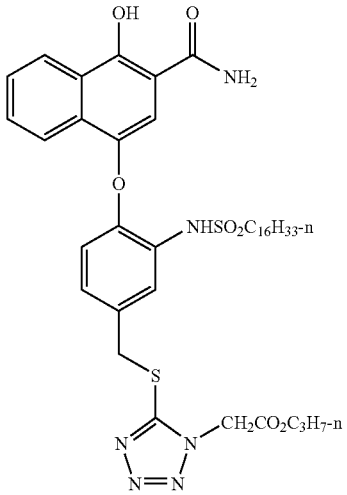
DIR-6:
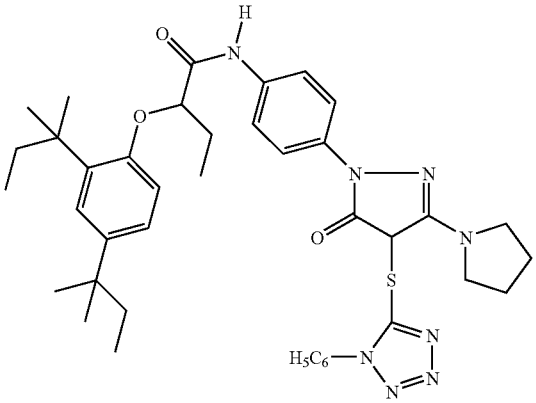
Y-1:
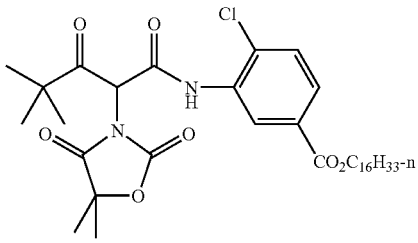
DIR-7:
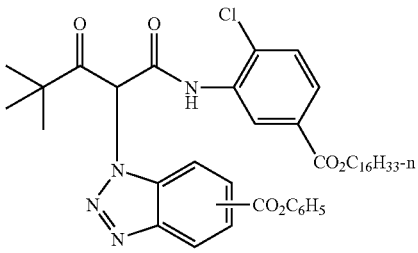
-continued
S-1:
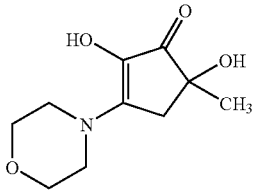
UV-2:
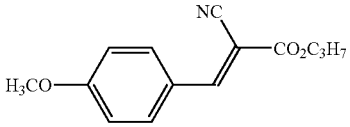
BSD-1:
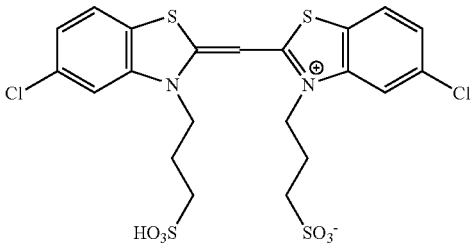
BSD-2:
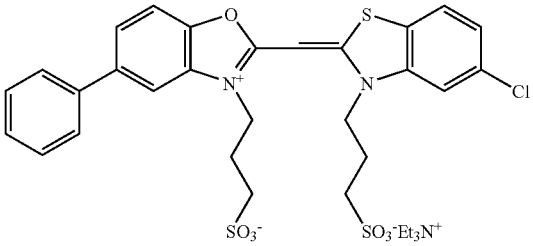
GSD-1:
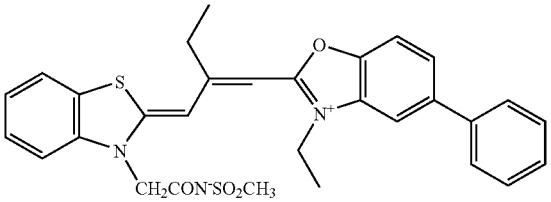
GSD-2:
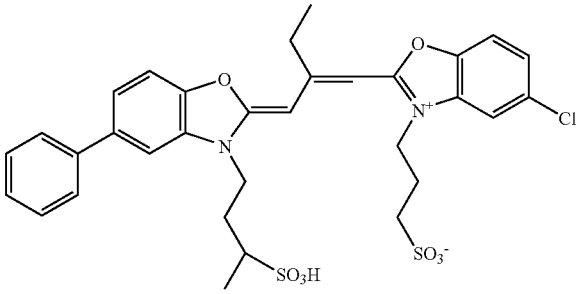

-continued

RSD-1:

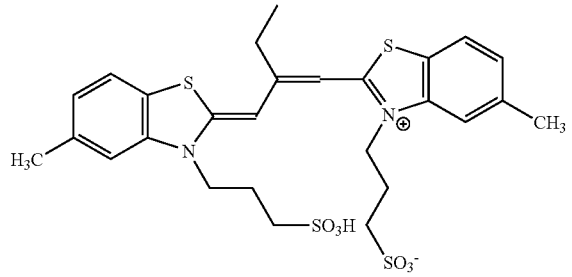

RSD-2:

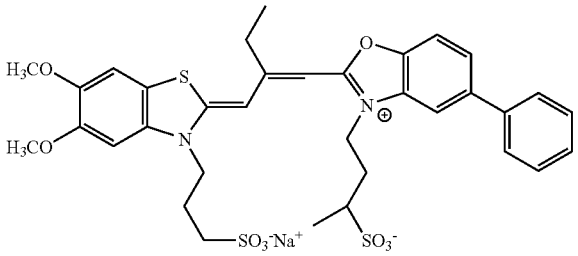

RSD-3:

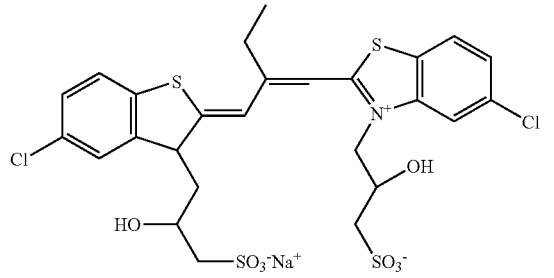

Comparative Compounds

CC1

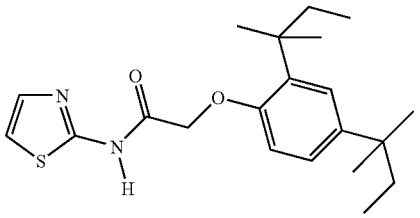

(7.38)

CC2

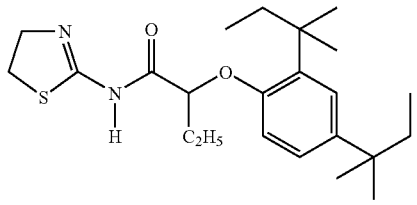

(8.05)

-continued

CC3

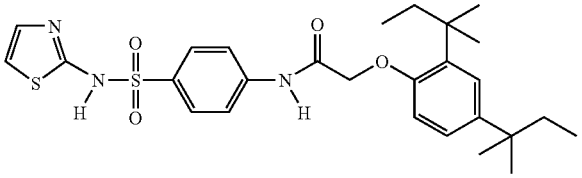

(7.97)

To determine speed these multilayer coatings were given a stepped neutral exposure and processed in the KODAK FLEXICOLOUR™ (C-41) process as described in *British Journal of Photography Annual,* 1988, pp 196-198. Speed or light sensitivity (given in terms of fraction of a stop) is inversely related to the exposure required to produce a specified film density (Ds) in the toe of a sensitometric D log E curve of 0.2× gradient (γ) at that density above $D_{min}$, i.e.

$$Ds=0.2\gamma+D_{min}.$$

The speed corresponds to the exposure which can be computed from Ds from the D log E curve. A larger, more positive number means increased speed: a negative number means a loss in speed. Granularity of the green layer in a neutral exposure was determined by the RMS method (see The Theory of the Photographic Process, $4^{th}$ Edition, T. H. James, pp 625-628) using a 48 micrometer aperture at the density 1.2 log exposure units from the speed point defined above.

Photographic data which illustrate the invention are given in the table below for certain thiazoles, pyrimidines and pyridazines, wherein ΔSpeed is the difference in speed between the check, the comparative compounds and the heterocycles for use in the invention.

TABLE 1

| Speed/Grain Addendum | Log Kow | Δ Speed (stops) | Comp/Inv |
|---|---|---|---|
| None | 0.00 | 0 | C |
| CC1 | 7.38 | −0.17 | C |
| CC2 | 8.05 | −0.07 | C |
| SGA1 | 11.01 | 0.20 | I |
| SGA2 | 10.67 | 0.17 | I |
| SGA3 | 10.91 | 0.07 | I |
| SGA34 | 9.90 | 0.03 | I |

The data in TABLE 1 show that the photographic speed of an element which contains a 'speed/grain' addendum is increased compared to the photographic element without the 'speed/grain' addendum or with comparable compounds with a lower Log Kow.

For example comparative compound CC1 with a Log Kow of 7.38 does not show a speed gain, whereas compound SGA3 of similar structure with a Log Kow 10.91 shows a speed gain of 0.07 stop. Also it will be noted that SGA1, which has a cyano electron-withdrawing group, has a higher speed gain than the corresponding analogue SGA3 which lacks this group. Similarly partially saturated CC2 with a Log Kow of 8.05 does not show a speed gain whereas the very similar SGA2 with a Log Kow of 10.67 shows a speed gain of 0.17 stop.

TABLE 2

| Speed/Grain Addendum | Log Kow | Δ Speed (stops) | Granularity ($\times 10^{-3}$) | Comp/Inv |
|---|---|---|---|---|
| Check | 0 | 0 | 21 | C |
| CC3 | 7.97 | 0 | 20 | C |
| SGA4 | 11.78 | 0.17 | 20 | I |
| SGA5 | 11.14 | 0.20 | 20 | I |
| SGA6 | 10.63 | 0.23 | 20 | I |
| SGA7 | 12.98 | 0.17 | 20 | I |
| SGA8 | 11.80 | 0.30 | 20 | I |
| SGA9 | 11.84 | 0.23 | 21 | I |
| SGA31 | 6.92 | 0.10 | 20 | I |
| SGA32 | 7.46 | 0.20 | 21 | I |
| SGA33 | 8.01 | 0.17 | 20 | I |
| SGA35 | 11.96 | 0.13 | 20 | I |
| SGA41 | 11.89 | 0.13 | 20 | I |
| SGA42 | 12.43 | 0.20 | 20 | I |

The data in TABLE 2 show that the photographic speed of an element which contains a 'speed/grain' addendum is increased compared to the photographic element without the 'speed/grain' addendum. In addition, the granularity (grain) of the element is either the same as or lower than that of the photographic element without the 'speed/grain' addendum. Therefore the 'speed/grain' addendum has provided an increase in photographic speed without an increase in granularity.

For example, the low Log Kow of comparative compound CC3 does not show the 'speed/grain' effect whereas the other compounds in the thiazole series SGA4 to SGA9 all show a speed gain of 0.17 or above, without granularity penalty. Also it will be noted that SGA8, which has an alkylsulfonyl electron-withdrawing group, has a higher speed gain than the corresponding analogue SGA7 which has an alkylthio group, which has a 'neutral' electronic effect. In the pyrimidine series SGA31 to SGA33 and SGA35 a similar 'speed/grain' effect is observed, with compounds having a Log Kow of 6.92 to 11.96 and speed gains of at least 0.10. For the pyridazines SGA41 and SGA42 with Log Kow values of 11.89 and 12.43 respectively, speed gains of 0.13 and 0.20 are shown.

The entire contents of the patent and publications referred to in this specification are incorporated herein by reference.

The invention has been described in detail with particular reference to preferred embodiments thereof but it will be understood that variations and modifications can be effected within the spirit and scope of the invention.

The invention claimed is:

1. A colour photographic element comprising at least one light-sensitive silver halide emulsion layer or a non silver-containing light-insensitive layer, in which at least one of these layers contains a colourless heterocyclic compound having either one or two hetero atoms in the ring or ring system, being other than an imidazole compound, that undergoes less than 10% chemical or redox reaction directly with oxidized developer and which has a partition coefficient to enable the photographic speed of the element to be increased by at least 0.03 stop without increasing granularity, compared to the same element without the compound.

2. The colour photographic element of claim 1 wherein the compound having either one or two hetero atoms in the ring or ring system undergoes less than 5% chemical or redox reaction directly with oxidised developer.

3. The colour photographic element of claim 1 wherein the compound is contained in the most light-sensitive layer of two or more light-sensitive layers having the same spectral sensitivity.

4. The colour photographic element of claim 1 wherein the compound is located in the green record wherein the maximum spectral sensitivity to light is from 500 to 600 nm.

5. The colour photographic element of claim 1 wherein the silver halide comprises silver iodobromide.

6. The colour photographic element of claim 1 wherein the compound has a partition coefficient to enable the photographic speed of the element to be increased by at least 0.10 stop without increasing granularity, compared to the same element without the compound.

7. The colour photographic element of claim 1 wherein the compound is selected from the class consisting of a thiazole, thiophene, pyrrole, furan, oxazole, pyrazole, pyridine, pyridazine, pyrimidine, pyrazine, oxazine, thiazine, diazepine, oxazepine, thiazepine, pyrrolopyrimidine, quinoline, benzoxazole, naphthyridine, benzoxazepine, indole and benzothiazole.

8. The colour photographic element of claim 1 wherein the compound has the formula (I):

(I)

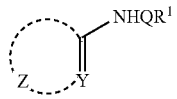

wherein

NHQ is selected from the class consisting of amido, ureido arylamino, carbamate or sulfonamido;

$R^1$ is a substituent;

Y is carbon or nitrogen; and

Z represents the atoms necessary to complete an unsubstituted or substituted five-, six- or seven-membered ring which may form part of a fused unsubstituted or substituted ring system, the ring or ring system containing either one or two heteroatoms selected from nitrogen, oxygen and sulfur, which may be bridgehead atoms;

provided that if Y is carbon, Z contains one or two heteroatoms but if Y is nitrogen Z must not contain more than one heteroatom.

9. The colour photographic element of claim 8 wherein Q is or contains an electron-withdrawing group.

10. The colour photographic element of claim 9 wherein Q is or contains a carbonyl or a sulfonyl group.

11. The colour photographic element of claim 10 wherein, when Q is or contains a carbonyl group, the ring or ring system represented by Z contains one or more electron-withdrawing groups.

12. The colour photographic element of claim 10 wherein, when Q is or contains a sulfonyl group, the ring or ring system represented by Z is unsubstituted or contains one or more electron-withdrawing or electron-donating groups.

13. The colour photographic element of claim 8 wherein, when Q is an aryl group, the ring or ring system represented by Z contains one or more electron-withdrawing groups.

14. The colour photographic element of claim 8 wherein Y is a nitrogen atom.

15. The colour photographic element of claim 8 wherein Z represents the atoms necessary to form an unsubstituted or substituted thiazole, pyrimidine or pyridazine ring.

16. The colour photographic element of claim 8 wherein the compound has one of the formulae (IIA), (IIB), (IIC) and (IID):

(IIA)

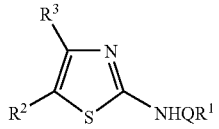

(IIB)

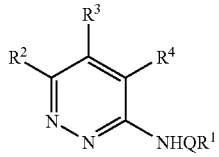

(IIC)

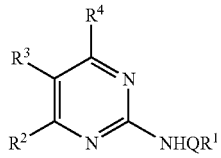

(IID)

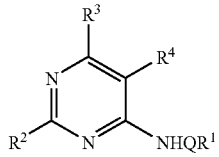

wherein $R^1$, $R^2$, $R^3$ and $R^4$ are independently selected substituents; and NHQ is selected from the class consisting of an amido, ureido arylamino, carbamato or sulfonamido group.

17. The colour photographic element of claim 8 wherein $R^1$ is selected from hydrogen and an unsubstituted or substituted alkyl, aryl, alkoxy, aryloxy, or alkyl- or arylamino group.

18. The colour photographic element of claim 8 wherein, when Q is a carbonyl group, $R^1$ is an alkyl group which is unsubstituted or substituted with an unsubstituted or substituted aryloxy group.

19. The colour photographic element of claim 8 wherein, when Q is a sulfonyl group, $R^1$ is a substituted aryl group.

20. The colour photographic element of claim 8 wherein, when Q is an aryl group, $R^1$ is an alkoxy group.

21. The colour photographic element of claim 16 wherein at least one of $R^2$ to $R^4$ is an electron-withdrawing group.

22. The colour photographic element of claim 16 wherein $R^2$ $R^4$ are independently selected from hydrogen and the class consisting of cyan, formyl, keto, carboxylic acid, mercapto and unsubstituted or substituted alkyl, aryl, alkoxy, aryloxy, alkoxy- or aryloxy-carbonyl, alkyl- or aryl-carbonyl, alkyl- or aryl-thio, alkyl- or aryl-sulfoxyl, alkyl- or aryl-sulfonyl, alkyl- or aryl-carbamoyl and alkyl- or aryl-carbonamido or two of $R^2$ to $R^4$ may join to form a fused ring which does not contain any heteroatoms.

23. The colour photographic element of claim 1 wherein the compound having either one or two heteroatoms is selected from the group consisting of

SGA1

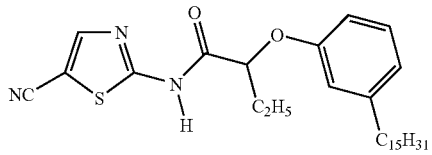

SGA5

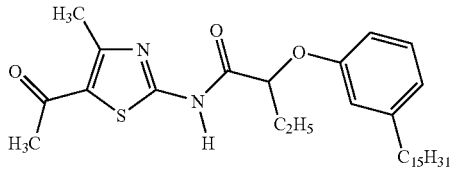

SGA6

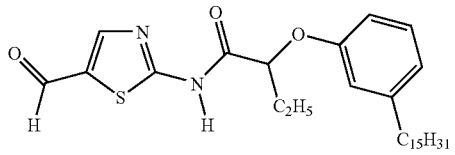

SGA8

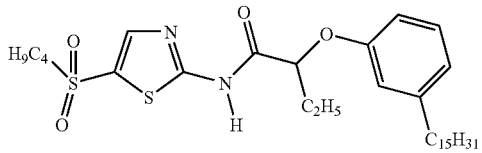

SGA9

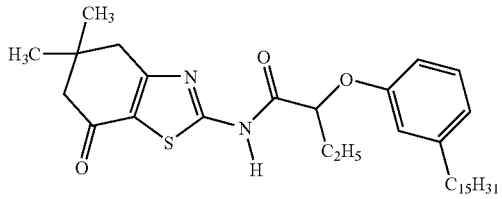

SGA32

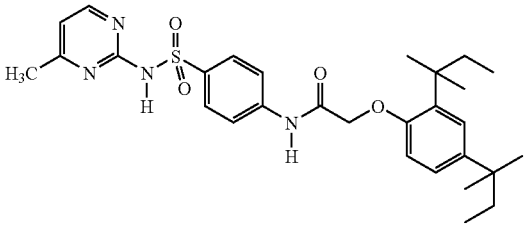

and

SGA42

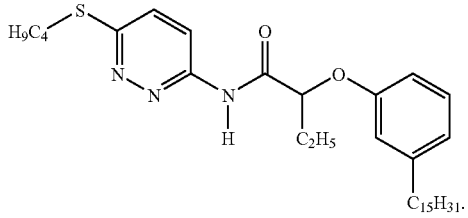

24. The colour photographic element of claim 1 wherein when the compound is present in a sensitized layer the ratio of compound to silver is at least 0.1 mmol compound per mol of silver halide.

25. The colour photographic element of claim 1 wherein when the compound is present in a non-silver-containing layer the laydown of the compound is at least $3\times10^{-5}$ mol/$m^2$.

26. A multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element may contain a non silver-containing light-insensitive layer, in which one at least of these layers contains a colourless heterocyclic compound having either one or two hetero atoms in the ring or ma system, being other than an imidazole compound, that undergoes less than 10% chemical or redox reaction directly with oxidized developer and which has a partition coefficient to enable the photographic speed of the element to be increased by at least 0.03 stop without increasing granularity, compared to the same element without the compound.

27. A process of forming an image in a colour photographic element after the element has been imagewise exposed to light, comprising contacting the element with a colour developing agent, wherein the element comprises at least one light-sensitive silver halide emulsion layer or a non silver-containing light-insensitive layer, in which at least one of these layers contains a colourless heterocyclic compound having either one or two hetero atoms in the ring or ring system, being other than an imidazole compound, that undergoes less than 10% chemical or redox reaction directly with oxidized developer and which has a partition coefficient to enable the photographic speed of the element to be increased by at least 0.03 stop without increasing granularity, compared to the same element without the compound.

* * * * *

UNITED STATES PATENT AND TRADEMARK OFFICE

CERTIFICATE OF CORRECTION

PATENT NO. : 7,354,701 B2
APPLICATION NO. : 10/574394
DATED : April 8, 2008
INVENTOR(S) : Bernard A. Clark et al.

It is certified that error appears in the above-identified patent and that said Letters Patent is hereby corrected as shown below:

| | |
|---|---|
| Claim 22, | In Claim 22, after "$R^2$" |
| Col. 63, line 55 | insert -- to --. |
| Claim 26, | In Claim 26, delete "ma" and |
| Col. 65, line 14 | insert -- ring --, therefor. |

Signed and Sealed this

Second Day of December, 2008

JON W. DUDAS
*Director of the United States Patent and Trademark Office*